US005253296A

United States Patent [19]

Castleberry, Jr. et al.

[11] Patent Number: 5,253,296

[45] Date of Patent: Oct. 12, 1993

[54] SYSTEM FOR RESISTING INTERCEPTION OF INFORMATION

[75] Inventors: John Castleberry, Jr., Cherry Hill; John D. Cavett, Pennsauken, both of N.J.

[73] Assignee: Communication Electronics, Cherry Hill, N.J.

[21] Appl. No.: 798,189

[22] Filed: Nov. 26, 1991

[51] Int. Cl.[5] ..... H04K 1/04

[52] U.S. Cl. ..... 380/36; 380/43; 380/49; 380/50

[58] Field of Search ..... 380/21, 35, 36, 37, 380/43, 44, 45, 48, 49, 50

[56] References Cited

U.S. PATENT DOCUMENTS 2,406,350 8/1946 Harrison .
3,012,100 12/1961 Mitchell .
3,225,142 3/1964 Schroeder .
3,731,197 5/1973 Clark .
3,773,977 11/1973 Guanella .
3,824,467 7/1974 French .
4,011,408 3/1977 Miller .
4,100,374 7/1978 Jayant et al. .
4,221,931 9/1980 Seiler .
4,232,193 11/1980 Gerard .
4,268,720 5/1981 Olberg et al. .
4,433,211 2/1984 McCalmont et al. .
4,598,168 7/1986 Komatsubara et al. ..... 380/35 X
4,683,586 7/1987 Sakamoto et al. .
4,731,839 3/1988 Goray et al. .
4,742,546 5/1988 Nishimura ..... 380/35
4,905,278 2/1990 Parker ..... 380/36 X
4,937,867 6/1990 Kasparian et al. ..... 380/35

*Primary Examiner*—Tod R. Swann
*Attorney, Agent, or Firm*—Thomas M. Ferrill, Jr.

[57] ABSTRACT

A time segment scrambling information encoding and decoding system wherein a multiplicity of scrambling algorithms are stored in a memory such as a ROM for use during transmission via a chosen medium and a multiplicity of correlated unscrambling algorithms are stored in memory for use during reception, the transmission equipment including apparatus which at different times substantially selects one of the scrambling algorithms to rely on in transmission until a different one of the scrambling algorithms is selected, the signals transmitted to receiving apparatus including finite-duration transmission of coordinating signal components by which the receiving and descrambling apparatus is caused to choose and rely on the coordinate algorithm there stored and to keep its restorative time-shifting of segments coordinated with the arrival of the time-shifted segments produced by the algorithm then being relied on at the transmitting point.

17 Claims, 15 Drawing Sheets

PROM OE 523 (FIG. 11)
358
PROM OE
+5V
READ MEMORY 387 (FIG. 7C)
361
357
DECIMAL COUNTER
CO
9
8
7
6
5
4
3
2
1
0
R
CI
362
PE 522 (FIG. 11)
COUNT DOWN 522 (FIG. 11)
COUNT UP 522 (FIG. 11)
364
365
READ CLOCK 372 (FIG. 7C)
359
U/D FF
+5V
U/D BIT 523 (FIG. 11)
366
DATA VALID
COUNT 1024 532 (FIG. 11)
356
FC/4 527 (FIG. 11)
355
READ PGM
+5V
READ CYCLE 307 (FIG. 7)
360
RCVD EOM PULSE 524 (FIG. 11)
LE
PWR-UP RESET
354

SYSTEM FOR RESISTING INTERCEPTION OF INFORMATION

BACKGROUND OF THE INVENTION

1. Field of the Invention

This invention relates to privacy communication systems, and particularly to systems in which information is so encoded, as by segmentation and scrambling of segments, as to gain the benefits of very restricted access. It is an object of this invention to provide a new and improved system of this character. It is a further object of this invention to make the meaningful reception of signals transmitted by wire or cable circuits, by radio, or by light beams with or without transmission through fibers, or other means, dependent upon the ability at the receiving station to recognize and react correctly to various changes of the algorithm which is key to restoration of scrambled signals as received to their original character.

2. Description of the Prior Art

Many systems have been described for the sending of scrambled signal transmissions and receiving and unscrambling of the transmission to recover the original signals. Among these prior systems are time-sequence scrambling systems for speech, for example, some of which involve scrambling and descrambling an original analog speech signal such as may be produced by microphone, with or without electronic amplification, and others of which involve digital encoded signal versions. The prior art includes U.S. Pat. Nos. 4,011,408 to Miller, 4,683,586 to Sakamoto et al, and 2,406,350 to Harrison. Note the text in Col. 4, line 56 et seq. of the Harrison patent as follows:

"Let it be assumed that the communicating parties have agreed on the codes that are to be used at a particular time and that perforated cards embodying such codes are in the code boxes at each station in accordance with the present invention. The sending of a start impulse from the contacts of the transmitting station releases all brush segments at all stations when brush 17 is on start segment 23. At each station, a release magnet 30, when energized, releases latch 31 and thereby allows the brushes 17 at all stations to start out on a revolution in phase with each other". U.S. Pat. Nos. 4,268,720 to Olberg et al, 3,225,142 to Schroeder and 4,221,931 to Seiler are also part of the prior art and contain statements about various prior art systems which said patentees had taken into account. An object of the present invention is to greatly increase the difficulty of trying to determine, and use, a key for successful unauthorized unscrambling of the signals being transmitted.

SUMMARY OF THE INVENTION

In the present invention, a multiplicity of predetermined algorithms which are stored and selectably accessable are provided in the sending station and a correlated multiplicity of algorithms is provided at the point at which the signals are to be received and utilized. Each of the stored algorithms at the sending station dictates one pattern for the change of sequence of the segments being transmitted, and its counterpart among the stored algorithms at the receiving point dictates the complementary change of sequence of the segments as received from the sending station whereby the signals can be converted back to the original sequence of segments and restored to intelligibility.

At the beginning of each transmission, and at shorter intervals if desired, a plurality of tone bursts are transmitted through the transmission medium from the sending station and received at the receiving point. Two such initial tones may be simultaneously transmitted for a predetermined very brief interval. At the sending station, and at the receiving point, these tones yield the encoding by which to select at each of said points that one of the stored algorithms which they represent. At least as often as a new transmission is commenced, and additionally, at one or more intermediate times during a transmission if desired, a new pair of tones is briefly transmitted and received, causing the transmitting equipment to be switched to a different algorithm and the receiving equipment to be simultaneously switched to the algorithm for a complementary series of time shifts of the received segments.

At the sending end, the set of tones denoting the algorithm to be used during the next ensuing time interval are chosen substantially randomly. This is done by causing a counter to proceed recurrently through a series of counts and momentarily responding to, and holding, the count through which the counter is proceeding when an initiating action such as a push-to-talk switch actuation, for example, occurs.

The very brief transmission of the tones not only maintains the coordination of the selections of the algorithms at the sending station and the receiving point but also provides synchronization between the scrambling function at the sending station and the unscrambling (restoring the original sequence) at the receiving point. In a preferred embodiment, this synchronization is accomplished in reliance upon the timing of the trailing edge of the tone bursts. This remains inherently correct, since the tone bursts experience the same delay in transmission as the information signals. The difficulties confronting a would-be interceptor of the information being sent in intended privacy include not only the problem of determining what the many necessary algorithms are for decoding, but also determining which algorithm is currently in use, and when and how to discontinue relying on that said algorithm and shift without loss of time to that one next algorithm made necessary by the new random algorithm selection at the sending point. The would-be interceptor is rendered virtually dependent upon somehow duplicating or obtaining a read-only memory unit (ROM) duplicating the ones then used at the intended receiving points. Such a would-be interceptor is also rendered virtually dependent upon somehow duplicating, or obtaining a duplicate, of the receiving apparatus with its tone-controlled circuits and its algorithm-selecting circuits. For heightened obstacles to unauthorized interception of information, the sending station may discontinue using one set of stored algorithms (e.g. one multi-algorithm read-only-memory [ROM]), in favor of a different ROM of algorithms, and, by prearrangement with the intended (i.e. authorized) receiving stations, have them concurrently change over to the further ROM of the available set of ROMs.

BRIEF DESCRIPTION OF DRAWINGS

The invention will now be described in detail in reference to the drawings, wherein:

FIG. 7, 7A, 7B and 7C form a schematic block diagram for the digital system memory control logic, wherein:

FIG. 7 is a schematic block diagram of the primary memory control logic for the digital system, FIG. 7A is a schematic block diagram of the memory select and write control logic, FIG. 7B is a schematic block diagram of the programmable-read-only memory control and interface logic, and FIG. 7C is a schematic block diagram of the read control logic.

DESCRIPTION OF A PREFERRED EMBODIMENT

Figure 1:
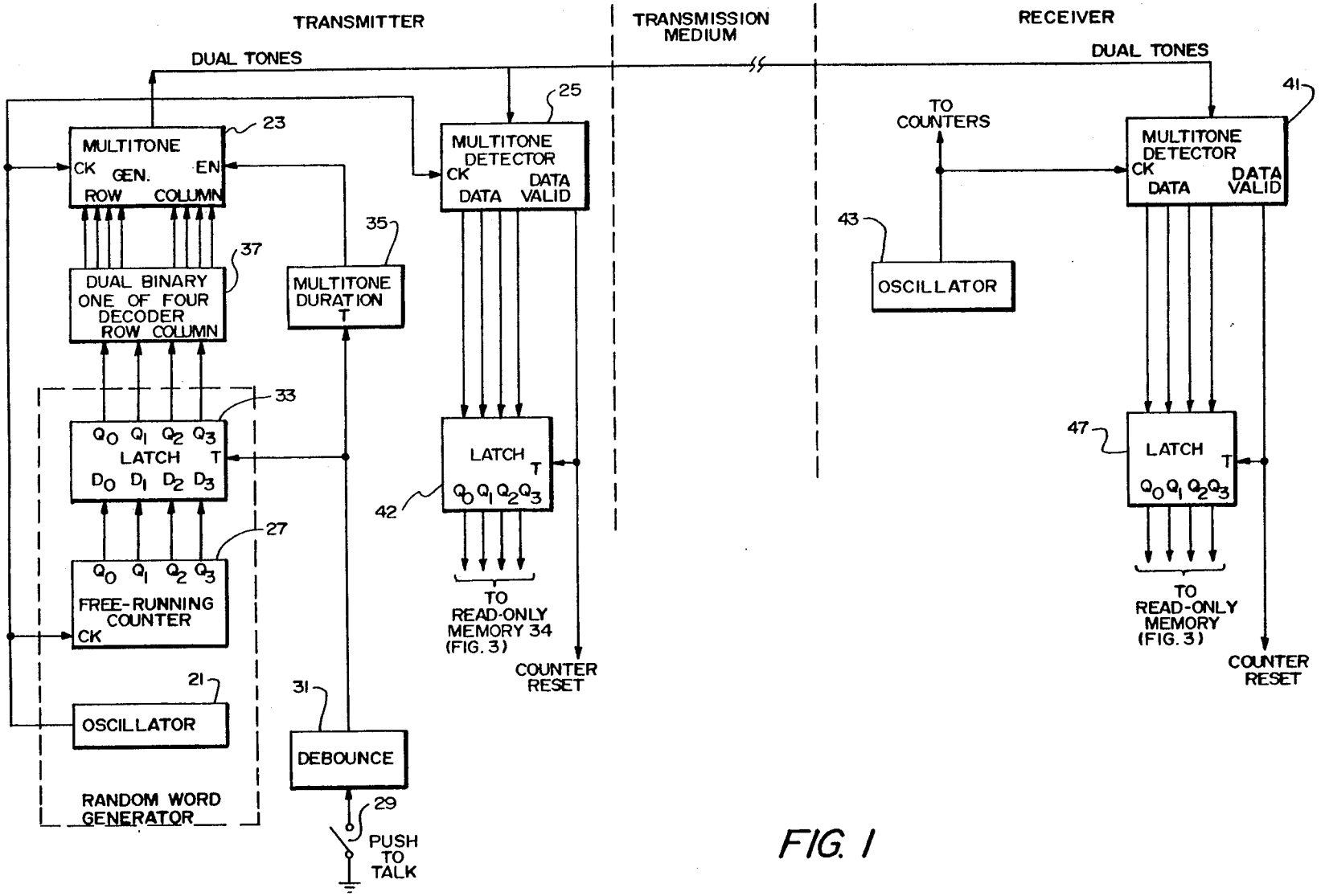
FIG. 1 is a block diagram of the signalling system used in both the analog and digital privacy systems.

The intelligence to be transmitted is contained in a signal presented to the system at the sending location. The transmitting system translates the signal into a new message which is not intelligible if it is intercepted during transmission by ordinary receiving equipment. The operation of the private communication system is not dependent upon a specific transmission system. Typically, telephone lines, a radio link, a microwave communication system, a light beam, etc. may be utilized for transmission of the scrambled signal in the private communication system.

At the receiving location, the transmitted message is delivered to the private communication system receiver which retranslates the message to reproduce the original signal intelligence.

The intelligence handled by the private communication system may, typically, be a voice signal; however, signals representing other forms of intelligence are not excluded. Although a transmitter and receiver have been specified for the sending and receiving locations, either of these two units may be constructed as a combination unit, i.e. a transceiver. Two way private communication may be carried out between two transceivers. While the terms used herein encompass apparatus useable in or in connection with radio transmitting and receiving apparatus, they also include within their scope apparatus for transmission via wire, cable, glass fibre, light beam, laser and any other media over whatever long or short distance traversed.

The private communication system of the present invention includes apparatus for conveying instructions between the transmitter and the receiver. In the preferred version, the message from the transmitter to the receiver is processed in the analog domain. In another version, the message from the transmitter to the receiver is processed in the digital domain. The following sections present detailed descriptions of the operation of the signalling system in the preferred version and thereafter the operation of a signalling system used in the digital version of the private communication system is described.

The signalling system conveys the control information required to coordinate the functions of the receiver with those of the transmitter. The control information described below is transmitted via the same link used for transmission of the scrambled message. This control information preferably includes a plurality of tones transmitted to notify the receiver of the "language" into which the intelligence of the communication has been translated. the multitone signal is also used to synchronize the processing of information in the receiver with the processing of information in the transmitter.

The multitone signal is transmitted as a preamble to the message. The duration of the multitone preamble in the preferred system (analog) is approximately 0.2 second, and in the alternate system (digital) the duration of the multitone preamble is approximately 1.0 second, in a system for scrambled voice transmission.

Referring to FIG. 1, oscillator 21 is the source of basic timing information for the entire system. Since system timing is relatively critical, a crystal oscillator is used. To accommodate the requirements of multitone generator 23 and multitone detector 25, an oscillating frequency of 3.579545 MHz (NTSC television color subcarrier frequency) was chosen. The output of oscillator 21 is also used in the derivation of other timing functions in the transmitter and the receiver.

In the transmitter portion of the signalling system, the output of oscillator 21 is fed to free-running counter 27. A free-running counter is one which is counting all of the time power is "on", and whose count is not interrupted by a reset pulse. Since counter 27 is not reset by either an external signal or by feeding back one of the outputs to a control input, the signal levels at the four least significant outputs will follow the pattern shown below:

0000 START
0001
0010
0011
0100
0101
0110
0111
1000
1001
1010
1011
1100
1101
1110
1111
0000 REPEAT

The above pattern recurs (i.e repeats) 223,721.5 times per second; hence, if the output of the counter is captured by a latch at a random time, the combination of one and zeros then in the latch can be said to be substantially random.

A push-to-talk switch 29 is preferably incorporated in the microphone circuit of those private communication systems designed for voice communication. Other means of initiating communication will be provided in non-voice systems. Since closure of push-to-talk switch 29 initiates a transmission, and release of push-to-talk switch 29 terminates the transmission, it is obvious that in the present design push-to-talk switch 29 remains closed for the duration of a transmission.

Debounce circuit 31 is provided to eliminate the effects of mechanical bouncing of the contacts of push-to-talk switch 29 or the contacts of a relay serving the purpose of push-to-talk switch 29. Since the period of mechanical bounce may be a millisecond or more, it is quite possible that transmission of a multitone signal determined by the output of free-running counter 27 at the time of initial closure of the contacts of push-to talk switch 29 could be interrupted by the output of free-running counter 27 a millisecond later resulting in the transmission of an erroneous multitone signal.

The output of debounce circuit 31 is applied to the toggle input of latch 33 and causes the four bits present at the output of free-running counter 27 to be stored in latch 33 at the instant of closure of push-to-talk switch 29, and these four bits appear at the output of latch 33. The output of debounce circuit 31 is also applied to the trigger input of multitone duration control circuit 35.

In the preferred (analog) embodiment of the private communication system, a monostable multivibrator 35 is used to generate the 0.2 second duration pulse which enables multitone generator 23, its function being that of a multitone duration control circuit. In the alternative (digital) version of the private communication system, the output of a counter having an interval of approximately one second determines the duration of the multitone signal. Multitone generator 23 is designed to accept instructions from an encoder unit comprising a $4\times4$ switch matrix so connected that the closure of a particular switch thereof activates one row output line and one column output line.

The four binary bits at the output of latch 33 represent the range of decimal numbers 0 through 15. Dual one-of-four decoder 37 is a device having the capability of accepting two two-bit binary numbers at the inputs and decoding each of the two-bit binary numbers into one of four decimal outputs. The two least significant bits of the four-bit binary number are fed to the input of one of the dual one-of-four decoder and two most significant bits are fed to the input of the the second of the dual one-of-four decoders. One line of each of the four outputs will be active [at a high level (+5 volts) as opposed to a low level (0 volts)].

Multitone generator 23 accepts four inputs representing the row connections of a four-by-four switch matrix and a second set of four inputs representing the column connections of a four-by-four switch matrix. The outputs resulting from the decoding of the two least-significant data bits stored in latch 33 are connected to the row inputs and the four decoder outputs representing the two most-significant bits stored in latch 33 are connected to the column inputs of multitone generator 23.

The inputs at the row and column connections define the particular combination of tones which will be present at the output of multitone generator 23 during the interval the enable input of multitone generator 23 is at a high logic level. There is minimal delay between the time at which the enable input of multitone generator 23 is taken high and the time of appearance of the selected pair of tones at the output of multitone generator 23.

The total electrical delay experienced by the signalling tones and the scrambled message while travelling through the signal path between the transmitter and receiver is not controlled; however, the group delay characteristic of the signal path must be within the limits prescribed for a telephone voice circuit. Further, a valid multitone signal must persist for approximately 45 milliseconds before multitone detector 25 will indicate that the received data is valid. Also, the data-valid signal at the output of multitone detector 25 will persist for approximately 45 milliseconds after the cessation of the multitone signal.

Key to understanding the synchronization of the operation of the transmitter and the receiver is the realization that the propagation delay experienced by the multitone signal is the same as that experienced by the scrambled message signal; hence, the multitone signal can be used to synchronize the operation of the receiver with that of the transmitter.

If the data-valid output of multitone detector 25 in the transmitter places all of the counters in a reset condition, the cessation of the data-valid signal (approximately 45 milliseconds after the end of transmission of the multitone signal) suffices to enable the data processing counters in the transmitter to start counting, thus causing the message signal to be processed at a known time with respect to the multitone signal. Processing of the message signal in the transmitter and the receiver starts at the cessation of the data-valid signal. The scrambled message signal and the multitone message preamble (from which the data-valid signal is derived) are subjected to the same transmission delay; hence, it is feasible to use the trailing edge of the data-valid signal to synchronize the operation of the receiver with the operation of the transmitter.

The four bits fed into multitone generator 23 will appear at the output of multitone detector 25 approximately 7 microseconds before the data-valid signal appears. During the interval in which the data-valid signal is present (a period approximately 45 milliseconds longer than the duration of the multitone signal), the four recovered bits are stored in latch 42.

Figure 3:
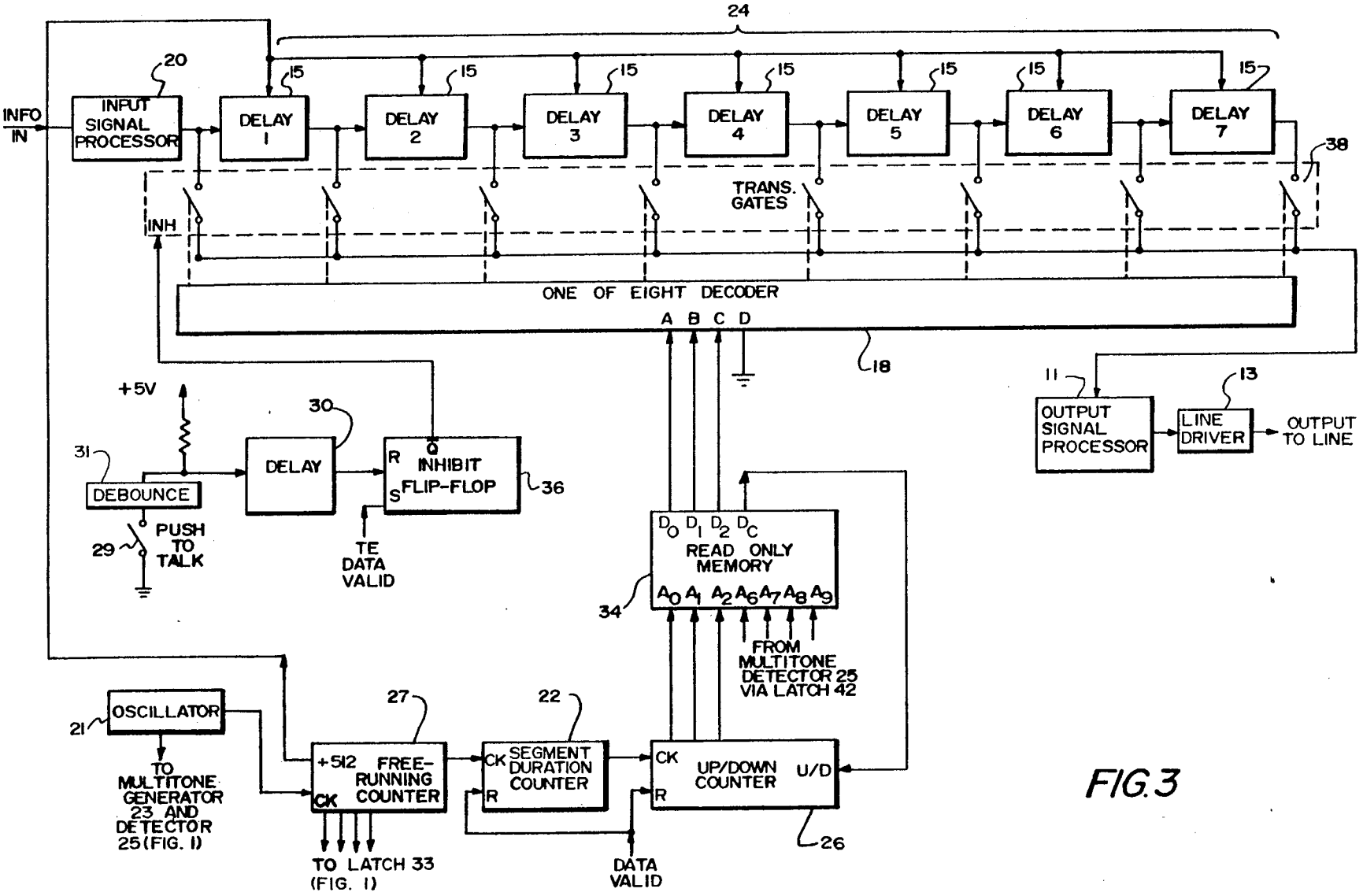
FIG. 3 is a block diagram of an analog version of a transmitter for privacy signalling.

The four bits at the output of latch 42 are applied to the address inputs of read-only memory 34 (FIG. 3). Read-only memory 34 contains the instructions for translating the original message into a scrambled form for transmission; hence, one discrete translation scheme is randomly selected each time push-to-talk switch 29 (FIGS. 1 and 3) is closed.

Figure 4:
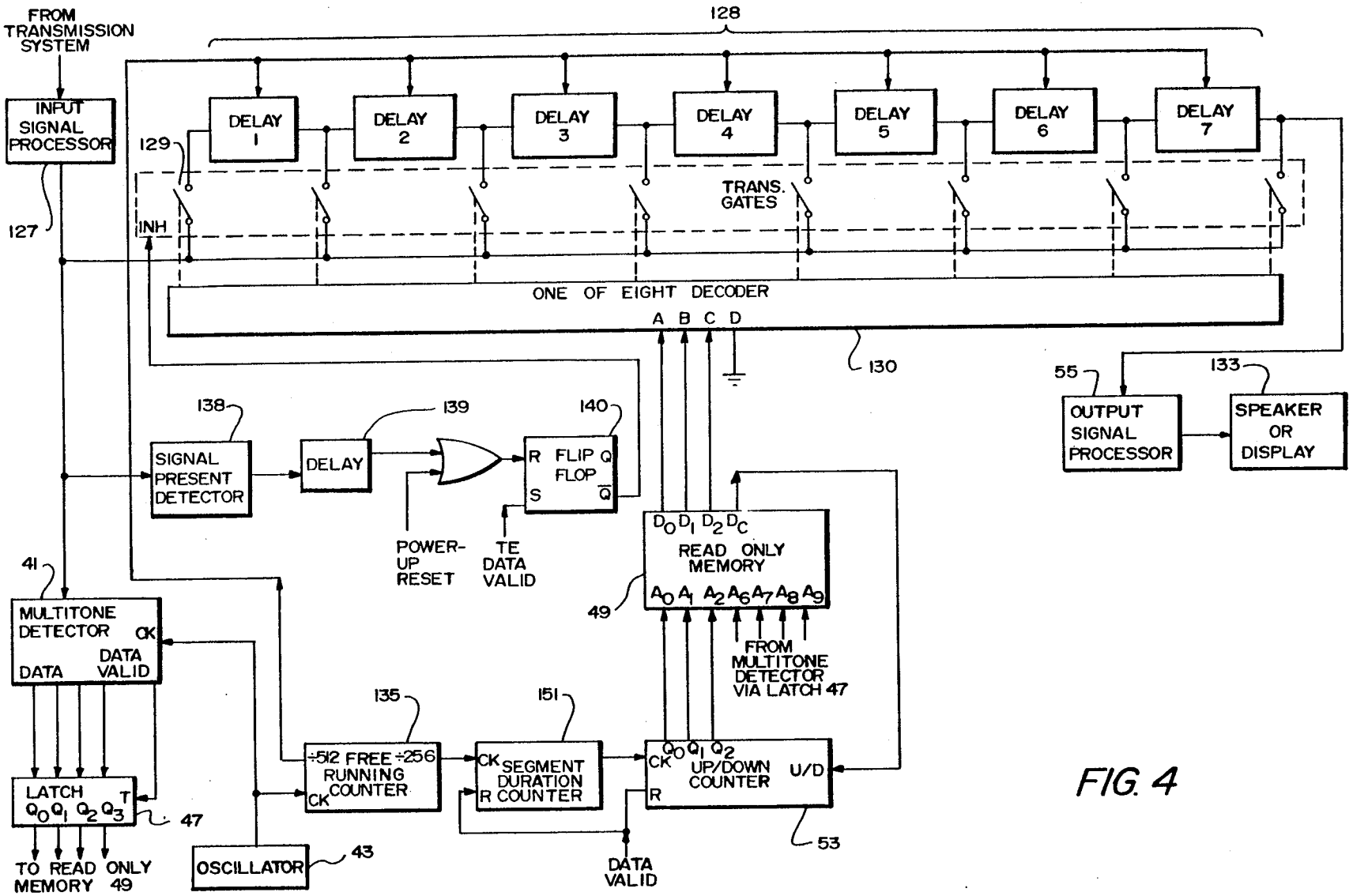
FIG. 4 is a block diagram of an analog version of a receiver for receiving and decoding the signals transmitted from the analog transmitter.

The signalling system receiver of FIGS. 1 and 4 is an abbreviated version of the signalling system in the transmitter. When system power is turned "on" the receiving system is in the "standby" mode. The receiver remains in the "standby" mode until a multitone signal is received and recognized as valid by receiver multitone detector 41.

Receiver oscillator 43 is crystal controlled and produces a clock signal very close to 3.579545 MHz (the same as the reference oscillator in the transmitter). This clock signal is utilized in receiver multitone detector 41 to control several switched capacitor filters which detect and decode the received multitone signal to recover the four bits which were fed into the transmitter dual one-of-four decoder 37 (FIG. 1), from the random word generator [including units 21, 27 and 33 (FIG. 1)]. When the multitone signal has been present without interruption and decoded for 45 milliseconds, the data-valid output of the receiver multitone detector 41 goes high. This data-valid output is applied as a reset to all of the counters involved in data processing in the receiver (cf. FIGS. 1 and 4). When the data-valid output of the receiver multitone detector 41 goes high, the data-valid signal causes the four bits representing the received multitone signal to be stored in receiver latch 47. These four bits remain in receiver latch 47 until such time as another valid multitone signal is received and the bits are replaced in latch 47 or system power is turned "off".

The four bits at the output of receiver latch 47 are applied to the address inputs of read-only memory 49 (both in FIG. 4). The data at the particular address in read-only memory 49 prescribes the method whereby the message can be retranslated into the original intelligence information. The cessation of the data-valid signal causes the data processing counters, segment duration counter 151 and up/down counter 53 to start the counting needed for retranslation of the scrambled information. The retranslated signal is fed to output signal processor 55 (all in FIG. 4).

Table 1 identifies an example of an integrated circuit useable for each block diagram function of the signalling systems.

TABLE 1

| Element | Item | IC Type | Source |
|---|---|---|---|
| 21 | Oscillator | CD4069U | RCA |
| 43 | | " | |
| 27 | Counter | CD4040 | RCA |
| 33 | Latch | CD4042 | RCA |
| 42 | | " | |
| 47 | | " | |
| 31 | Debounce | R-C Integrator or CMOS buffer with feedback | |
| 37 | Dual one-of-four decoder | CD4555 | RCA |
| 23 | Multitone Generator | CD22859 | RCA |
| 35 | Multitone Duration one-shot | CD4098 | RCA |
| 25 | Multitone Detector | SSI202 | Radio Shack |
| 41 | | " | |

Timing diagram (FIG. 2) shows the timing relationship between the various elements of the signalling system:

The top line (A) of the timing diagram (FIG. 2) illustrates the action of push-to-talk switch 29 (FIG. 1). Until this switch is closed, the system remains in the standby mode. When push-to-talk switch 29 (FIG. 1) is closed, the system enters the transmit mode and remains in the transmit mode until push-to-talk switch 29 (FIG. 1) is released.

The second line (B) of the timing diagram (FIG. 2) represents the output of multitone duration control circuit 35 (FIG. 1).

It should be noted that there is no delay of concern (a few nanoseconds) in debounce circuit 31 (FIG. 1) or latch 33 (FIG. 1).

The third line (C) of the timing diagram (FIG. 2) shows a signal envelope representing the transmitted multitone signal. Since there is negligible delay in the multitone generator circuits, the starting and ending of the dual tone envelope is shown coincident with the enabling pulse from multitone duration one-shot 35 (FIG. 1).

Figure 2:
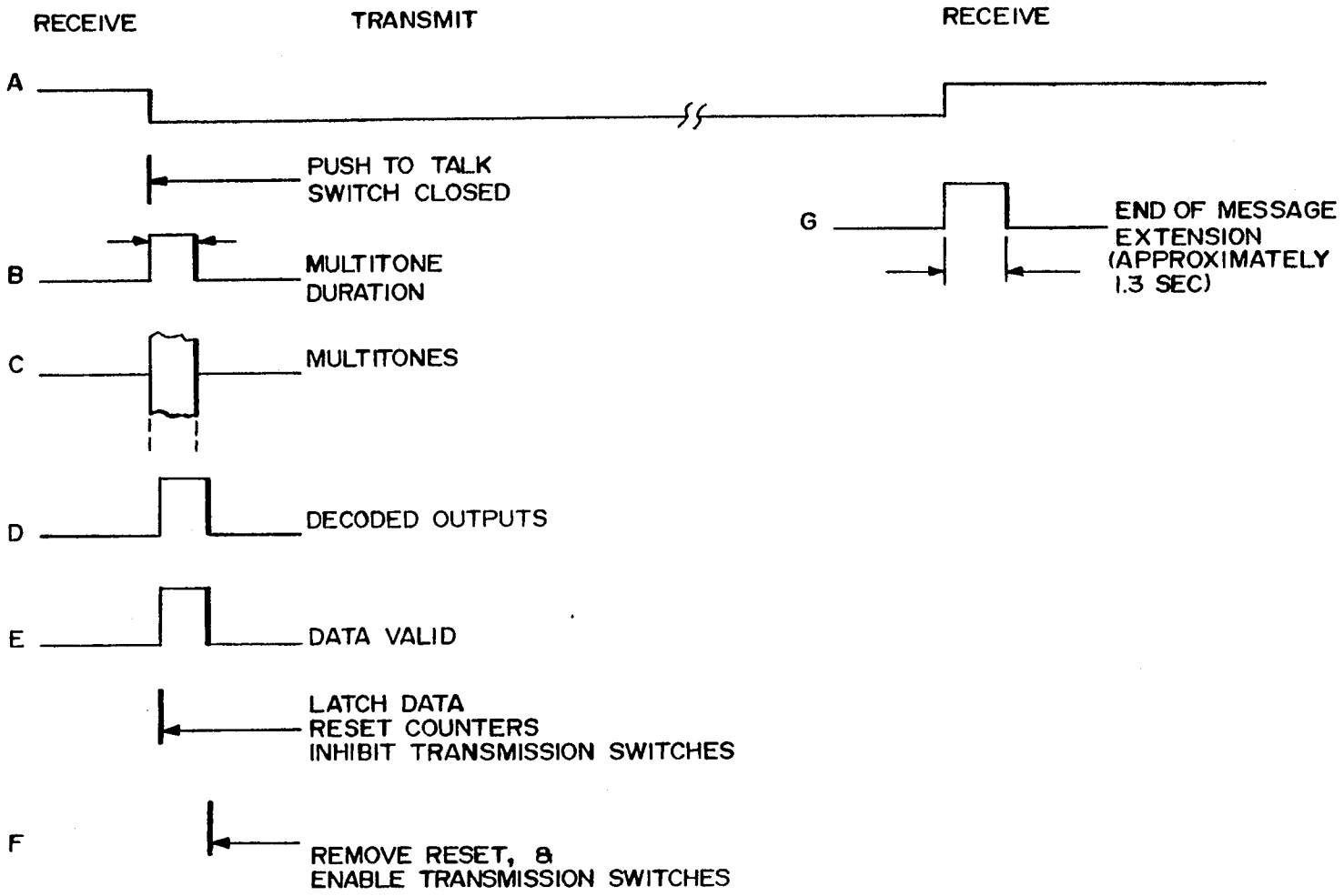
FIG. 2 is a series of waveforms showing the time relationship of major events in analog privacy system operation.

The fourth line (D) of FIG. 2 represents the occurrence of the data outputs of multitone detector 25 (FIG. 1). The time of occurrence of the data-valid signal is delayed (approximately 45 milliseconds) with respect to the initiation of the received multitone signal. Also, the cessation of the data-valid signal is delayed (45 milliseconds) with respect to the end of transmission of the multitone signal.

Four bits of information recovered from the received multitone signal appear at the data outputs of multitone detector 25 approximately 7 microseconds before the appearance of the data-valid signal output of multitone detector 25 (FIG. 1). The delayed timing of the data-valid signal relative to the appearance of the data outputs is shown by line (E) of timing diagram (FIG. 2). The four recovered data bits are stored in latch 42 throughout the transmission.

The extension of the transmit interval after release of push-to-talk switch 29 (FIG. 1) is illustrated by waveform (G) (FIG. 2).

In the receive portion of the signalling system (FIG. 1), the system is in the "standby" mode until such time as a valid multitone signal is received. Upon arrival of a valid multitone signal, (line C, FIG. 2) the receiving process is initiated.

The appearance of the data-valid signal is delayed (45 milliseconds) with respect to the time of arrival of the valid multitone signal. The data-valid signal places the signal processing counters in the reset mode and disables the signal selector switches in the receiver.

During the data-valid signal interval, the four bits representing the decoded multitone signal are stored in receiver latch 47 (FIG. 1) for application to the address inputs of read-only memory 49 (FIG. 4). At the end of the data-valid signal, the reset is removed from the signal processing counters and the signal selector switches are enabled.

The time of the start of processing message information with respect to the trailing edge of the multitone signal is the same in the transmitter and the receiver; hence, the operation of the two units is synchronized.

In the preferred system (the analog system) of privacy communication, whether between plural transceivers or between a transmitter and one or more receivers, there is preferably provided at the transmitting point a delay line consisting of a series of switched-capacitor delay elements (also known as "Charge Coupled Devices" or "Bucket Brigade Devices") to divide the incoming signal into discrete segments having durations of approximately one-eighth second. These segments are rearranged in a controlled manner to obscure the intelligence contained in the transmitted message signal.

The preferred system requires minimal components for implementation.

The following paragraphs provide a detailed description of the operation of the analog transmitter (FIG. 3). The analog transmitter accepts an intelligence signal from an information source [for example, speech output from a microphone (with or without amplification)], processes the signal to suit the transmission medium, rearranges the segments of information into one of numerous predetermined random patterns, and feeds the resulting signal to the transmission medium.

The block diagram of the analog transmitter FIG. 3), heretofore referred to, will be further explained.

Part of the analog transmitter is the signalling system discussed in a previous section of this disclosure.

The information to be transmitted is fed to input signal processor 20 (FIG. 3) where the input signal level is set and is filtered to remove any out-of-band components. Also, protective devices may be incorporated to protect the transmitter from high voltage noise on the input line.

From input signal processor 20 (FIG. 3), the signal is fed into a delay line comprising a series of discrete delay elements 15 collectively denoted 24 (FIG. 3). The delay system 24 (FIG. 3) propagates the input signal therethrough in a period determined by the number of delay elements in the circuit path and the delay element clock rate. The operation of a delay element 15 can be visualized as a series of sampling circuits (approximately 2000 per delay element) wherein the instantaneous voltage present at the input of a sampling circuit is sampled and transferred to the next sampling circuit of the element on the following clock cycle. This process continues until the first sample is passed to the output of the delay element. As this first sample was passed along the sampling circuits of delay element 15, the next level present at the input of delay element 15 was sampled and started on the path through a delay element 15. In this manner, a sine wave fed into the input of delay system 24 would appear at the output of delay system 24 as a series of voltage samples following the input sine waveform and delayed with respect to the input waveform. In one example, the clock rate and the number of stages in the delay element 15 were chosen to yield a delay of approximately 146 milliseconds per element; hence, the delay through such a seven element delay system would be 1.022 seconds.

Oscillator 21 was discussed in detail in the section describing the operation of the signalling system.

Free-running counter 27 provides several outputs essential to the operation of the transmitter as discussed in the following paragraphs:

The bits present at the four least significant outputs of free-running counter 27 at the time of closure of push-to-talk switch 29 are stored in latch 33 (FIG. 1) and define the random number which determines the algorithm for rearranging the segments of the message.

A divide-by-256 output of counter 27 (FIG. 3) is the clock signal for segment duration counter 22. This output is further divided to produce a 6.8 Hz segment rate.

A divide-by-512 output of free-running counter 27 serves as the clock for delay system 24.

The output of segment duration counter 22 serves as the clock for up/down counter 26. The up/down control of counter 26 (FIG. 3) follows an output of read-only memory 34. A data bit at every memory location in read-only memory 34 instructs up/down counter 26 to count up or to count down. If this bit is a zero, up/down counter 26 will be incremented by each clock pulse from the address pointed to by the four bits recovered from the transmitted multitone signal. If this bit is a one, up/down counter 26 will be decremented by each clock pulse from the address pointed to by the four bits recovered from the transmitted multitone signal.

The data processing counters (segment duration counter 22 and up/down counter 26) are held in reset by the data-valid output of multitone detector 25.

Action of the transmission gates, units 38, is inhibited until inhibit flip flop 36 is set. Since the first information to be transmitted is coincident with the trailing edge of the data-valid signal, removing the inhibit on the action of transmission gates unit 38 by setting inhibit flip flop 36 with the trailing edge of the data-valid signal establishes synchronism of the transmitted message signal with the data-valid signal.

At the end of the message [signalled by the release of push-to-talk switch 29 (FIG. 3)] transmission must continue until all of the information stored in delay system 24 has been transmitted. The delay in the ending of the transmission interval is accomplished by using the positive-going trailing edge of the push-to-talk switch signal to trigger end-of-message delay 30 (FIG. 3). At the termination of the end-of-message interval (approximately 1.3 seconds), inhibit flip flop 36 (FIG. 3) is reset and the transmission is terminated.

At the end of the data-valid signal interval, up/down counter 26 (FIG. 3) will start from 000 (the reset output of the counter); therefore, the starting address for read-only memory 34 will be determined by the four data bits recovered from the transmitted multitone signal. If it is desired to repeat a particular sequence of segments, the instruction to count up or count down would be repeated at each of the eight addresses (000 through 111).

Read-only memory 34 (FIG. 3) is programmed so that the three binary bits appearing at its least significant data outputs ($D_0$, $D_1$, $D_2$) select the input of the first delay element of delay system 24 or the output of one of the several delay elements of said delay system 24. The sequence in which the outputs of the several delay elements are selected is determined by the scrambling algorithm selected for the particular transmission.

The three data outputs of read-only memory 34 are connected to the data inputs of one-of-eight decoder 18. Only one output of one-of-eight decoder 18 goes high in response to any combination of ones and zeros applied to the data inputs of one-of-eight decoder 18. The eight outputs of delay line 24 are connected to the corresponding inputs of the respective transmission gate 38 (FIG. 3). The outputs of the eight transmission gates 38 are tied together to form a common path for the scrambled output signal. The common output of the transmission gates is fed to the input of output signal processor 11 (FIG. 3).

The eight outputs of one-of-eight decoder 18 are connected in order (output one of one-of-eight decoder 18 is connected to the gate element of the transmission gate 38 whose input is connected to the input of the first delay element of delay system 24, and so on). With this arrangement, the segments of the message are delivered to output signal processor 11 in the order prescribed by read-only memory 34. Output signal processor 11 incorporates a low pass filter to eliminate any clock noise present in the signal. Provision is made for setting the level of the signal fed to line driver 13. Line driver 13 conditions the signal to meet the requirement for transmission of the signal via the selected transmission medium.

Table 2 identifies examples of elements such as integrated circuit units which may be used in the block diagram functions of the analog transmitter FIG. 3.

TABLE 2

| Element | Item | Type | Source |
|---|---|---|---|
| 20 | Input Signal Processor | TL082 | Texas Instruments |
| 11 | Output Signal Processor | " | |
| 13 | Line Driver | " | |
| 15 | Delay Element | MN3008 | Panasonic |
| 21 | Oscillator | CD4069U | RCA |
| 27 | Free-running Counter | CD4040 | RCA |
| 22 | Segment Duration Counter | CD4040 | RCA |
| 26 | Up/down Counter | CD4516 | RCA |
| 34 | Read-only memory | 2716 | National |

TABLE 2-continued

| Element | Item | | Source |
|---|---|---|---|
| | | | Semiconductor |
| 38 | Transmission Gates | CD4066 | RCA |
| 18 | One-of-eight Decoder | 1-CD4555<br>1-CD4556 | RCA<br>RCA |
| 30 | Delay One-shot | CD4098 | RCA |
| 36 | Inhibit Flip-flop | CD4013 | RCA |
| | Additional suitable parts relative to FIG. 1 | | |
| | | IC Type | |
| 23 | Multitone Generator | CD22895 | RCA |
| 33 | Quad Latch | CD4508 | RCA |
| 42 | | " | |
| 47 | | " | |
| 37 | Dual-binary One-of-four Decoder | CD4555 | RCA |
| 25 | Multitone Detector | CD22204 | RCA |
| 41 | | " | |

The analog receiver (FIG. 4) accepts the signal arriving via the transmission medium, rearranges the scrambled segments of information into the original sequence and processes the recovered intelligence signal for presentation to the user.

A necessary part of the analog receiver is the previously discussed signalling system. The information received from the transmission system is fed to input signal processor 127 where the level of the signal is set and the signal is filtered to remove any out-of-band components. Also, protective devices may be incorporated in input signal processor 127 to protect the receiver from high level noise spikes induced into the transmission system.

From input signal processor 127, the signal is fed into a set of transmission gates 129 which control the point along delay system 128 (a series of delay elements) at which a particular message segment enters the signal recovery system.

The output of input signal processor 127 is fed to multitone detector 41 where the four bits determining the message segment sequence and the data-valid signal are recovered. The output of input signal processor 127 is also fed to signal present detector 138 which is enabled by the trailing edge of the data-valid signal. Signal-present detector 138 maintains a high level output as long as a signal is being received. At the termination of the input signal, the shift in level at the output of signal present detector 138 triggers end-of-message delay one-shot 139 which delays the reset of inhibit flip flop 140 for approximately 1.3 seconds after the last message information is received. This period is sufficiently long for the last received segment of information to be processed through the system.

The outputs of one-of-eight decoder 130 are held at zero (0) as long as the inhibit is active (high level). This means that none of the transmission gates of unit 129 will pass data while the inhibit is in effect. Inhibit flip flop 140 is set by the trailing edge of the data-valid signal. In this mode, transmission gates 129 will follow the instructions of read-only memory 49.

The output of oscillator 43 (3.579545 MHz) is present at all times power is on. This signal is divided-by-eight and is fed to multitone detector 41 where it is utilized in the detection and decoding of the multitone signal arriving via the transmission medium. The multitone signal must persist for a minimum of 45 milliseconds to be considered valid. The output of oscillator 43 is also fed to free-running counter 135. The divide-by-512 output of free-running counter 135 is the clock for delay elements 128. The divide-by-256 output of free-running counter 135 is the clock for segment duration counter 151.

The occurrence of the data-valid signal places segment duration counter 151 and up/down counter 53 in reset. These counters remain in reset [each presenting a low logic level (0) at its output] as long as the data-valid signal persists. At the same time the reset is applied to segment duration counter 151 and up/down counter 53, the four bits representing the received multitone signal are applied to the address inputs ($A_6$ through $A_9$) of read-only memory 49.

The three least significant bits at the output of up/down counter 53 are applied to the three least significant address inputs ($A_0$, $A_1$, $A_2$) of read-only memory 49. Remembering that up/down counter 53 is held in reset by the data-valid signal, it is recognized that the information appearing at the data outputs of read-only memory 49 is determined by the four bits recovered from the received multitone signal. The three least significant data bits at the output of read-only memory 49 are applied to the data inputs of one-of-eight decoder 130 and a fourth output of read-only memory 49 is applied to the up/down control of up/down counter 53.

When the reset is removed from segment duration counter 151 and up/down counter 53, inhibit flip flop 140 is set. Setting inhibit flip flop 140 removes the inhibit from transmission gates 129 so that transmission gates 129 will follow the instructions appearing at the data outputs of read-only memory 49. This instant coincides with the arrival of the first segment of information from the transmitter.

While segment duration counter 151 is timing the duration of the first segment (approximately 146 milliseconds), the first segment of data is fed into delay system 128 at its left-hand end or at an intermediate point therealong as determined by the four bits recovered from decoding the multitone message preamble.

Since the instruction at each particular address in read-only memory 49 is the descrambling complement of the scrambling algorithm at the same address in read-only memory 34 in the transmitter (FIG. 3), the incoming segments of information will be transposed to the order in which they arrived at input signal processor 20 of the transmitter (FIG. 3).

The output of delay system 128 is fed to output signal processor 55. Output signal processor 55 sets the level of the output signal and removes any sampling noise added to the signal as it was processed through delay system 128. The speaker or display 133 transforms the electrical signal from the output of signal processor 55 to an audible or visible form as required by the application.

Table 3 sets forth examples of parts useable in the construction of an analog receiver:

TABLE 3

| Element | Title | IC Type | Source |
|---|---|---|---|
| 127 | Input Signal Processor | TL082 | Texas Instruments |
| 55 | Output Signal Processor | " | |
| 128 | Delay System | MN3008 | Panasonic |
| 43 | Oscillator | CD4069U | RCA |
| 135 | Free-running Counter | CD4040 | RCA |

TABLE 3-continued

| Element | Title | IC Type | Source |
|---|---|---|---|
| 151 | Segment Duration Counter | " | |
| 53 | Up/Down counter | CD4516 | RCA |
| 49 | Read-only Memory | 2716 | National Semiconductor |
| 129 | Transmission Gates | CD4066 | RCA |
| 130 | One-of-eight Decoder | 1-CD4555<br>1-CD4556 | RCA<br>RCA |
| 41 | Multitone Detector | CD22204 | RCA |
| 47 | Quad Latch | CD4508 | RCA |

Figure 5:
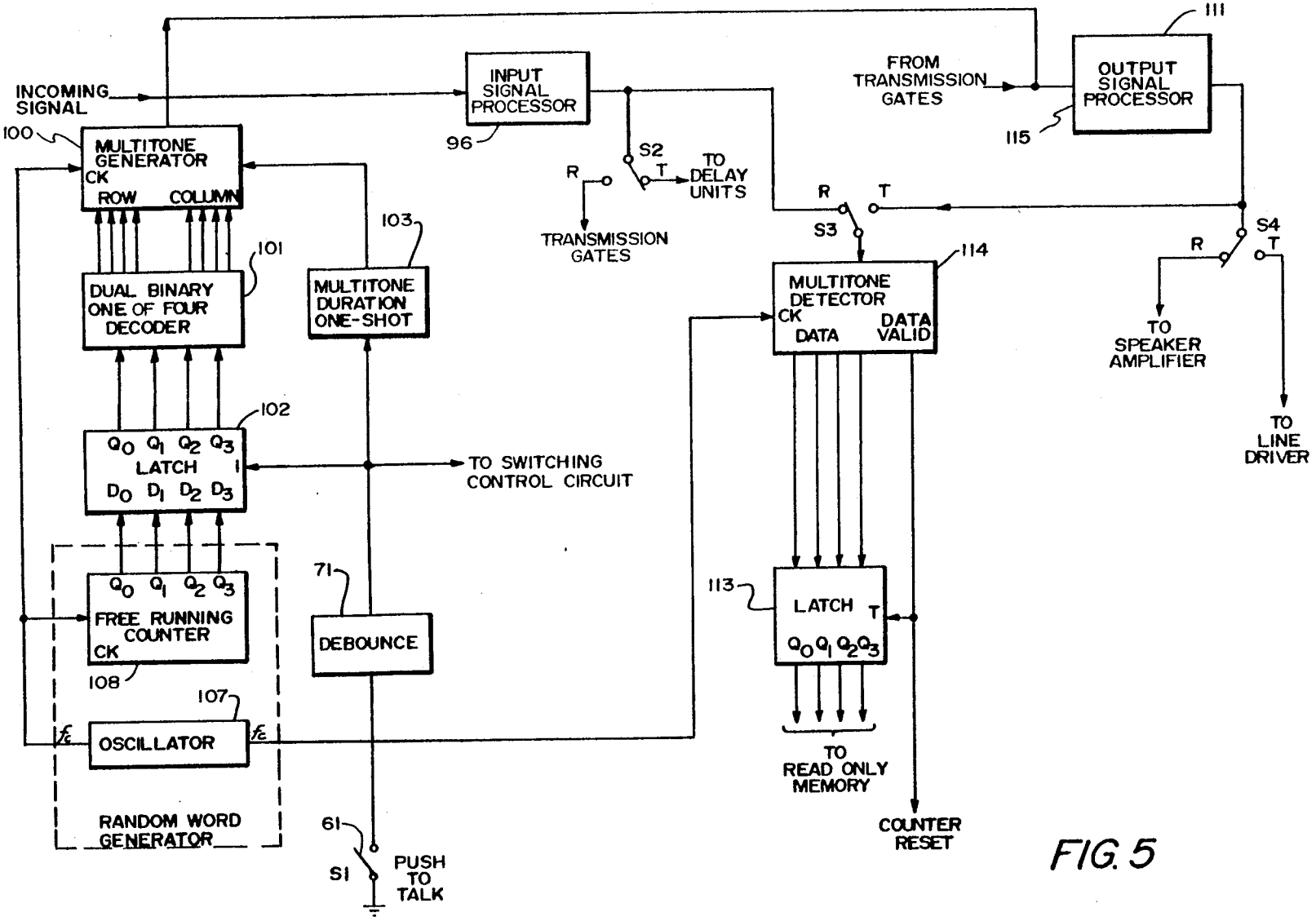
FIG. 5 is a schematic block diagram of a signalling system transceiver.
Figure 6:
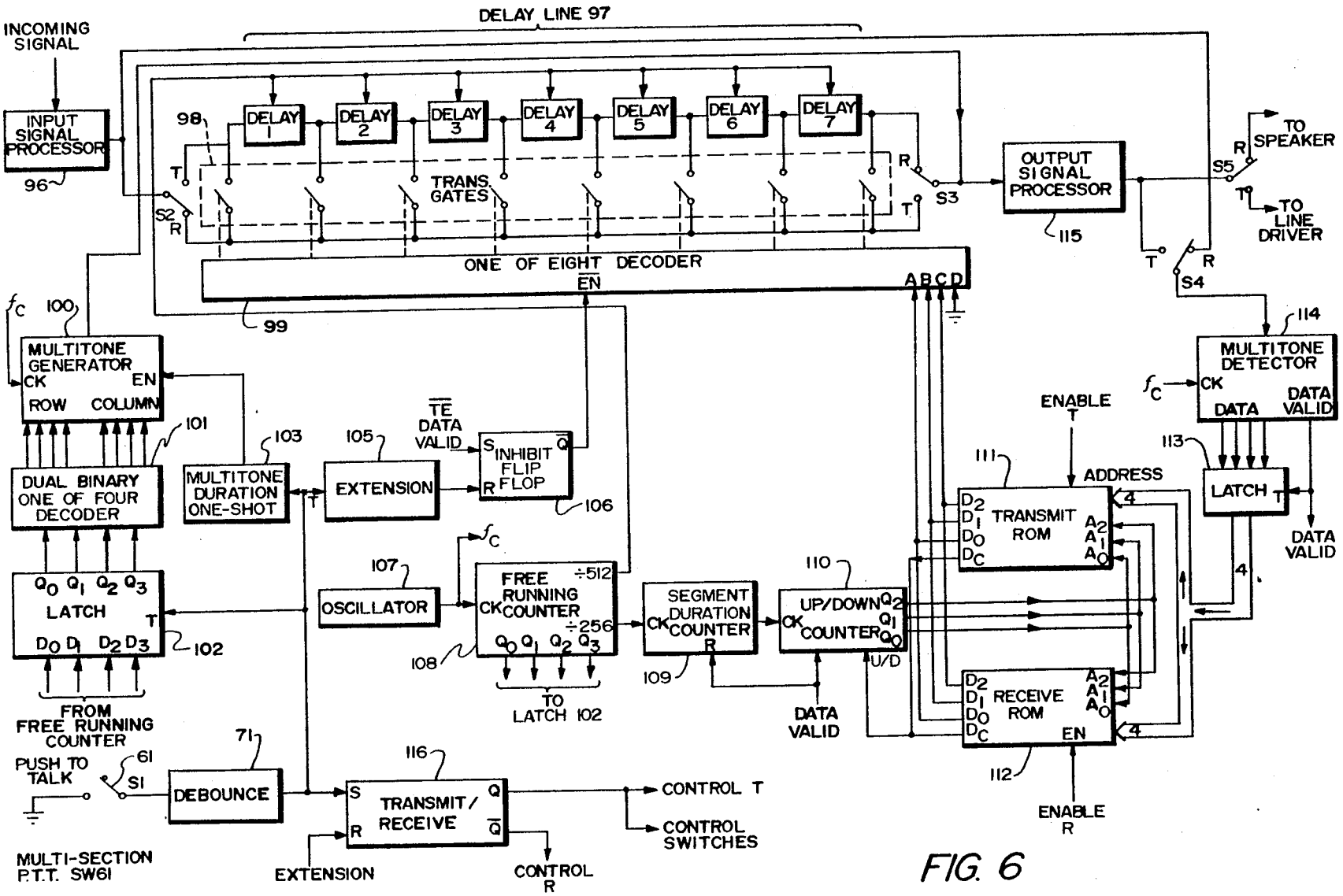
FIG. 6 is a schematic block diagram of an analog privacy transceiver.

There are many components and functions which are identical in the above described analog transmitter and analog receiver. FIG. 5 and FIG. 6 present an analog signalling system and an analog transceiver, respectively, which substantially reduces the duplication of components and functions, while retaining the full capability of the separate transmitter and receiver, to the extent that the latter may be used for communication to and from a given position or a given vehicle.

The switch sections ($S_1$ through $S_5$) of push-to-talk switch 61 (FIGS. 5 and 6) are shown in the receive position. Each of these switch sections is moved to its alternate position when the system enters the transmit mode. Also, when power is turned on or the system leaves the transmit mode, the system automatically returns to the receive mode. Operation of the system in the transmit mode is discussed in the following paragraphs.

As noted above, when system power is turned on, the system automatically enters the receive mode. In this mode (as in the transmit mode) oscillator 107 is operative and supplies the reference frequency (3.579545 MHz). The clock signals for free-running counter 108, multitone generator 100 and multitone detector 114 are derived from the output of oscillator 107. Several other control signals are derived from the outputs of these devices.

When push-to-talk switch 61 (including section $S_1$) is closed for transmitting a message, the level at the input to debounce circuit 71 changes from a high level (+5 volts) to a low level (0 volts). Any perturbation of the signal at the input to debounce circuit 71 is removed. The control level at the output of debounce circuit 71 performs several functions as follows:

Transmit/receive flip flop 116 is set (that is, the Q output is at a high level and the $\overline{Q}$ output is at a low level).

The four bits appearing at the least significant outputs of free-running counter 108 at the instant of closure of push-to-talk switch 61 are stored in latch 102.

Multitone Duration one shot 103 is triggered by the negative-going edge at the output of debounce circuit 71. This is the opposite of the action of extension one-shot 105 which triggers on the positive-going edge at the output of debounce circuit 71. This choice of triggers configures the circuit so that multitone duration flip flop 103 (FIG. 6) triggers when push-to-talk switch 61 is closed and extension one shot 105 (FIG. 6) is triggered when push-to-talk switch 61 opens.

The control T line enables transmit read-only memory 111. This very simple memory control system is possible since the read-only memory selected for this application has a tri-state output which, when read-only memory 111 is not selected, presents a high impedance to the data bus. When control T is active, the information appearing at the data outputs of transmit read-only memory 111 are present on the data lines. (Via the enable function in the receive read-only memory 112, control R line serves the same purpose in the receive mode as the control T line serves in the transmit mode).

All switch sections ($S_1$ through $S_5$) are transferred to the transmit position.

Transmit read-only memory 111 is enabled.

The four bits stored in latch 102 are fed to the inputs of dual-one-of-four decoder 101. The two least-significant bits stored in latch 102 are decoded by dual-one-of-four decoder 101 and the decoded output is applied to the row inputs of multitone generator 100. In like manner, the two most-significant bits at the output of latch 102 are decoded and the decoded output is appled to the column inputs of multitone generator 100.

During the active interval of multitone duration one-shot 103 (approximately 0.2 second) multitone generator 100 produces a multitone signal at its output. The frequencies of the multitone signals are determined by the four bits stored in latch 102. These tones are fed to multitone detector 114 via output signal processor 115 and section $S_4$ of push-to-talk switch 61.

After the multitone signal has been present at the input of multitone detector 114 and successfully decoded for approximately 45 milliseconds, a set of four bits identical to those stored in latch 102 will appear at the data outputs of multitone detector 114. Approximately 7 microseconds after the appearance of these four bits, a data-valid signal will appear at the data-valid output of multitone detector 114. It should be repeated that the data-valid signal and the four bits persist at the outputs of multitone detector 114 for approximately 45 milliseconds after the end of the multitone signal.

The data-valid output of multitone detector 114 is used as follows:

The leading edge of the data-valid signal strobes latch 113 to store the four data bits present at the output of multitone detector 114. These bits will remain stored in latch 113 until another valid multitone signal is received or system power is turned off.

The data-valid signal is used as a reset for segment duration counter 109 and up/down counter 110.

The inverted trailing edge of the data-valid signal sets inhibit flip flop 106 so that one-of-eight decoder 99 is enabled. The simultaneous removal of the reset on the counters and the enabling of one-of-eight decoder 99 synchronizes the start of transmission with the ending of the data-valid signal.

The four bits stored in latch 113 are applied to the address inputs of both the receive and the transmit read-only memories. However, since the transceiver is in the transmit mode, only the output of transmit read-only memory 111 will appear on the data bus.

During the period of the data-valid signal, segment duration counter 109 and up/down counter 110 are held in reset. Under these conditions, the outputs of both counters will be zero. Hence, the first segment to be selected for transmission will be the one pointed to by the four bits obtained by decoding the transmitted multitone signal.

One output of the read-only memories is designated ($D_c$) to control up/down counter 110 and is connected to the up/down control of counter 110. This bit is a part of the data stored at each particular address and determines whether up/down counter 110 will be incremented or decremented at the end of each segment of transmitted data.

In response to the information stored in transmit read-only memory 111, each group of seven segments of a particular message will be transmitted in a predetermined sequence. If the duration of the message is greater than one second, the sequence of segments in the second and succeeding groups will be repeated.

The start of the message signal enters the first section of delay system 97 via switch $S_2$. This first segment of the message may be selected by transmission gates 98 to be the first segment transmitted or it may be propagated through delay system 97 and selected at a later time. Each of the elements of delay system 97 introduces a delay of approximately 146 milliseconds. The process continues as each segment of a one second message is selected in the sequence specified by the information stored in transmit read-only memory 111.

When the end of a particular message is signalled by the release of push-to-talk switch 61, it is highly probable that some information will remain in delay system 97.

The release of push-to-talk switch 61 triggers extension one-shot 105. This one-shot delays the reset of transmit/receive one-shot 116 for approximately 1.3 seconds (1.3 seconds is more than enough time to guarantee that transmission of a particular message is complete).

The transceiver leaves the transmit mode and enters the receive mode when extension flip flop 105 times out and transmit/receive flip flop 116 is reset.

Referring to FIG. 6, the block diagram of the analog transceiver, will be of help in understanding the following paragraphs describing the operation of the analog transceiver in the receive mode.

When system power is turned on, the system automatically enters the receive mode. Under these conditions:

Oscillator 107 commences generating the reference signal (3.579545 MHz) from which the clock signals for all of the circuits are derived.

All of the switch sections ($S_1$ through $S_5$) are placed in the receive position. The system will remain in the receive mode until push-to-talk switch 61 is closed or system power is turned off.

The system will remain in what is, effectively, a standby mode until a valid multitone signal is received and recognized. Nothing will pass through transmission gates 98 (One-of-eight decoder 99 being disabled) until a data-valid signal appears at the output of multitone detector 114.

All incoming signals are passed through input signal processor 96. In this unit, the signals are fed through a low pass filter to remove any out-of-band components, the signal level is set, and any voltage spikes are removed. The output of input signal processor 96 feeds the input of the first selected one of the transmission gates 98 via switch section $S_2$, and the input of multitone detector 114 via switch sections $S_3$ and $S_4$.

When a valid multitone signal is received, multitone detector 114 measures the duration of the multitone signal and if the duration is greater than 45 milliseconds, four bits representing the particular multitone signal will appear at the output of multitone detector 114.

Approximately 7 microseconds after the appearance of the four bits at the output of multitone detector 114, a data-valid signal will appear at an output of multitone detector 114.

The data-valid signal is applied as a reset to segment duration counter 109 and up/down counter 110.

The leading edge of the data-valid signal is applied as a trigger to latch 113 where it causes the four data bits at the output of multitone detector 114 to be stored in latch 113. These four bits will remain in latch 113 until another valid multitone signal is received or system power is turned off.

The four bits recovered from the received multitone signal are fed to the address inputs of transmit read-only memory 111 and receive read-only memory 112. Only receive read-only memory 112 will recognize the presence of the four address bits. This results from the fact that in the receive mode receive/transmit flip flop 116 is reset; hence, transmit read-only memory 111 is disabled and receive read-only memory 112 is enabled.

Three data bits and a control bit ($D_c$) appear at the data outputs of receive read-only memory 112. Since segment counter 109 and up/down counter 110 are held in reset by the data-valid signal, the information specifying where the first received message segment is to be fed into the set of delay elements 97 is determined by the four bits obtained by decoding the incoming multitone signal.

The three data bits appearing at the output of receive read-only memory 112 are applied to the inputs of one-of-eight decoder 99. This decoder produces a high level at one, and only one, of its eight outputs in response to the information from receive read-only memory 112. The high level at the input of the selected one of transmission gates 98 causes the incoming signal to enter the series of delay elements 97 at the point specified by read-only memory 112. When segment duration counter 109 reaches a count of 1024 (approximately 146 milliseconds after the beginning of the segment) up/down counter 110 is clocked. This counter will be incremented or decremented in response to the information present at up/down counter 110's control input. The direction of the count (increment or decrement) is determined by the control bit present at the $D_c$ output of receive read-only memory 112. Of course, the instruction will be proper to retranslate the incoming message.

The retranslated message will be fed to a speaker or other transducer via output signal processor 115. This processor includes a low pass filter to eliminate sampling noise induced into the signal. Processor 115 also includes means for setting the level of the outgoing signal.

Table 4 delineates examples of parts which may be used in the construction of an analog transceiver.

TABLE 4

| Element | Title | IC Type | Source |
|---|---|---|---|
| 96 | Input Signal Processor | TL082 | Texas Instruments |
| 115 | Output Signal Processor | " | |
| 97 | Delay System (Composed of 7 Delay Elements) | MN3008 | Panasonic |
| 98 | Transmission Gates | CD4066 | RCA |
| 99 | One-of-eight Decoder | 1-4555 1-4556 | RCA |
| 100 | Multitone Generator | CD22859 | RCA |
| 101 | Dual one-of-four Decoder | CD4555 | RCA |
| 102 | Dual Quad latch | CD4508 | RCA |
| 113 | | " | |
| 103 | Duration One-shot | CD4098 | RCA |
| 105 | Extension One-shot | " | |
| 71 | Debounce | RC Integrator or CMOS buffer with | |

TABLE 4-continued

| Element | Title | IC Type | Source |
|---|---|---|---|
| | | feedback | |
| 106 | Signal Inhibit Flip Flop | CD4013 | RCA |
| 116 | Transmit/receive Flip Flop | " | |
| 107 | Oscillator | CD4069U | RCA |
| 108 | Free-running Counter | CD4040 | RCA |
| 109 | Segment Duration Counter | " | RCA |
| 110 | Up/down counter | CD4516 | RCA |
| 111 | Read-only memory | 2716 | National Semiconductor |
| 112 | | " | |
| 114 | Multitone Detector | SSI202 | Radio Shack |

DESCRIPTION OF AN ALTERNATE EMBODIMENT OF A PRIVACY TRANSMISSION SYSTEM

A substantial difference between the preferred embodiment (analog system) and the alternate embodiment (digital system) of the present invention lies in the choice of the delay system wherein the segments of the message are held until they are selected for transmission. In the analog system, a delay line performs the storage function, and in the digital system, a solid state memory performs the storage function.

In the digital system, the incoming message signal is converted to digital form and the data representing the message is stored in a solid state memory. The digital data is read out of memory in segments which have, for example, a duration of approximately one-eighth of a second.

To minimize the bandwidth required to transmit the digitized message, the data read from memory is converted to analog form and is filtered to remove quantizing noise before transmission.

The designation of the sequence in which the segments of information are read from memory is conveyed to the receiver by a multitone preamble to the transmitted message.

A system of memory control logic for the digital transmitter, digital receiver, and digital transceiver is set forth in FIGS. 7, 7A, 7B and 7C. The active elements are designated by conventional symbology. Table No. 5, set forth below, provides an illustrative tabulation of available solid-state devices which may be used in constructing the memory control system from small scale integrated circuit devices. Certain portions of the memory control logic system will be referred to in the description of the operation of the transmitter, receiver, and transceiver of FIGS. 9, 10 and 11 respectively. These are followed by a more detailed description of the of the memory control logic system.

Illustrative examples of components useable in the memory control logic are set forth below:

TABLE 5

| Element | Item | IC Type | Source |
|---|---|---|---|
| 301 | D Flip Flop | CD4013 | RCA |
| 308 | | " | |
| 314 | | " | |
| 326 | | " | |
| 335 | | " | |
| 355 | | " | |
| 358 | | " | |

TABLE 5-continued

| Element | Item | IC Type | |
|---|---|---|---|
| 359 | | " | |
| 371 | | " | |
| 389 | | " | |
| 392 | | " | |
| 317 | S-R Flip Flop | CD4044 | RCA |
| 324 | | " | |
| 340 | | " | |
| 342 | | " | |
| 345 | | " | |
| 374 | | " | |
| 376 | | " | |
| 382 | | " | |
| 302 | 2-input AND | CD4081 | RCA |
| 316 | | " | |
| 320 | | " | |
| 323 | | " | |
| 334 | | " | |
| 351 | | " | |
| 352 | | " | |
| 353 | | " | |
| 356 | | " | |
| 364 | | " | |
| 365 | | " | |
| 377 | | " | |
| 384 | | " | |
| 387 | | " | |
| 390 | | " | |
| 394 | | " | |
| 396 | | " | |
| 398 | 2-input AND | CD4081 | RCA |
| 303 | Inverter | CD4049 | RCA |
| 321 | | " | |
| 329 | | " | |
| 330 | | " | |
| 331 | | " | |
| 343 | | " | |
| 362 | | " | |
| 304 | 3-input AND | CD4073 | RCA |
| 309 | | " | |
| 312 | | " | |
| 313 | | " | |
| 315 | | " | |
| 328 | | " | |
| 347 | | " | |
| 348 | | " | |
| 305 | 2-input OR | CD4071 | RCA |
| 306 | | " | |
| 307 | | " | |
| 310 | | " | |
| 311 | | " | |
| 325 | | " | |
| 327 | | " | |
| 332 | | " | |
| 333 | | " | |
| 336 | | " | |
| 339 | | " | |
| 341 | | " | |
| 344 | | " | |
| 346 | | " | |
| 354 | | " | |
| 360 | | " | |
| 361 | | " | |
| 366 | | " | |
| 367 | | " | |
| 373 | | " | |
| 375 | | " | |
| 379 | | " | |
| 380 | | " | |
| 383 | | " | |
| 391 | | " | |
| 393 | | " | |
| 397 | | " | |
| 399 | | " | |
| 318 | U/D Counter | CD40193 | RCA |
| 319 | One-shot | CD4098 | RCA |
| | | | RCA |
| 322 | 3-input OR | CD4075 | RCA |
| 327 | | " | |
| 337 | Decimal Counter | CD4017 | RCA |

TABLE 5-continued

| Element | Item | IC Type | |
|---|---|---|---|
| 357 | | " | |
| 372 | | " | |
| 338 | 2-input NAND | CD4011 | RCA |
| 349 | | " | |
| 350 | | " | |
| 385 | | " | |
| 386 | | " | |
| 378 | 2-input NOR | CD4001 | RCA |
| 381 | | " | |
| 395 | | " | |

It will be readily apparent to those skilled in the relevant technologies that large scale integrated circuits may be used to provide the functions of a multiplicity of small scale integrated circuits, thereby achieving greater compactness and simplicity of construction.

Illustrative examples of available integrated circuits which may be used in constructing the transmitter, receiver and transceiver of FIGS. 9, 10 and 11, respectively, are set forth below in Tables 6, 7 and 8, respectively, and are followed by descriptions of the operation of the digital transmitter, the digital receiver, and the digital transceiver.

TABLE 6

Illustrative integrated circuits useable in the digital transmitter:

| Element | Title | IC Type | Source |
|---|---|---|---|
| 240 | Push-to-talk switch | — | — |
| 241 | Input Signal Processor | TL082 | Texas Instruments |
| 246 | Output Signal Processor | " | |
| 242 | Analog to Digital Converter | MAX150 | Maxim Integrated Products |
| 244 | Delay | RC Delay | |
| 245 | Digital to Analog Converter | AD7224 | Maxim Integrated Products |
| 247 | Tone Duration Flip Flop | CD4013 | RCA |
| 272 | Divide-by-two | " | |
| 248 | Multitone Generator | CD22859 | RCA |
| 249 | Random Access Memory | CDM6264 | RCA |
| 250 | | " | |
| 251 | Multitone Detector | SSI202 | Radio Shack |
| 252 | Dual one-of-four Decoder | CD4555 | RCA |
| 253 | Write address Counter | CD4040 | RCA |
| 260 | Free-running Counter | " | |
| 254 | Tri-state Buffer | CD4503 | RCA |
| 255 | | " | |
| 256 | Read Address Counter | CD40193 | RCA |
| 257 | Dual Quad Latch | CD4508 | RCA |
| 259 | | " | |
| 258 | Programmable Read Only Memory | 2732 | National Semiconductor |
| 261 | Oscillator | CD4069U | RCA |
| 262 | Memory Control Logic (See Table 5) | | |
| 263 | Segment Duration Counter | CD40163 | RCA |
| 264 | Segment Counter | " | |
| 265 | 2-input AND | CD4081 | RCA |
| 266 | 2-input OR | CD4071 | RCA |
| 267 | 3-input OR | CD4075 | RCA |
| 273 | | " | |
| 274 | Hex inverter | CD4049 | RCA |

TABLE 6-continued

Illustrative integrated circuits useable in the digital transmitter:

| Element | Title | IC Type | Source |
|---|---|---|---|
| 243 | Hex Buffer | CD4050 | RCA |
| 268 | | " | |
| 269 | | " | |
| 270 | | " | |
| 271 | Divide-by-223 | CD4068<br>CD4049 | RCA |

TABLE 7

Illustrative components useable in a digital receiver.

| Element | Title | IC Type | Source |
|---|---|---|---|
| 401 | Input Processor | TL082 | Texas Instruments |
| 404 | Output Processor | " | |
| 402 | Analog-to-Digital Converter | MAX150 | Maxim Integrated Products |
| 403 | Digital-to-Analog Converter | AD7224 | Maxim Integrated Products |
| 405 | Random Access Memory | CDM6264 | RCA |
| 406 | | " | |
| 407 | Multitone Detector | SSI202 | Radio Shack |
| 408 | Hex Inverter | CD4049 | RCA |
| 419 | | " | |
| 409 | Quad Latch | CD4508 | RCA |
| 410 | D Flip Flop | CD4013 | RCA |
| 418 | Divide-by-two | " | |
| 411 | Decode 0000 | CD4078 | RCA |
| 412 | 2-input OR | CD4071 | RCA |
| 424 | | " | |
| 428 | | " | |
| 413 | Write Address Counter | CD4040 | RCA |
| 414 | Tri-state Buffer | CD4503 | RCA |
| 415 | | " | |
| 416 | Read Address Counter | CD40193 | RCA |
| 417 | Programmable read-only memory | 2732 | National Semiconductor |
| 420 | 2-input AND | CD4081 | RCA |
| 421 | 2-input NAND | CD4011 | RCA |
| 422 | Divide-by-223 | CD4068<br>CD4049 | RCA |
| 425 | Memory Control Logic (see Table 5) | | |
| 426 | Segment Counter | CD40163 | RCA |
| 429 | Segment Duration counter | " | |
| 427 | Oscillator | CD4049U | RCA |

TABLE 8

Illustrative components useable in a digital transceiver.

| Element | Title | IC Type | Source |
|---|---|---|---|
| 501 | Input Signal Processor | TL082 | Texas Instruments |
| 504 | Output Signal Processor | " | |
| 502 | Analog-to-Digital Converter | MAX150 | Maxim Integrated Products |
| 503 | Digital-to-Analog converter | AD7224 | Maxim Integrated Products |
| 505 | Random Access Memory | CDM6264 | RCA |
| 506 | | " | |
| 507 | Multitone Detector | SSI202 | Radio Shack |
| 508 | Hex Inverter | CD4049 | RCA |
| 533 | | " | |
| 534 | | " | |
| 509 | D Flip Flop | CD4013 | RCA |
| 511 | | " | |

TABLE 8-continued

Illustrative components useable in a digital transceiver.

| Element | Title | IC Type | Source |
|---|---|---|---|
| 531 | | " | |
| 510 | 3-input OR | CD4075 | RCA |
| 538 | | " | |
| 512 | Delay | RC Integrator | |
| 513 | 2-input OR | CD4071 | RCA |
| 514 | Multitone Generator | CD22859 | RCA |
| 515 | Dual Quad Latch | CD4508 | RCA |
| 526 | | " | |
| 516 | Decode 0000 | CD4078 | RCA |
| 518 | Dual one-of-four decoder | CD4555 | RCA |
| 519 | Write Address Counter | CD4040 | RCA |
| 527 | Free-running Counter | " | |
| 520 | Tri-state Buffer | CD4503 | RCA |
| 521 | | " | |
| 522 | Read Address Counter | CD40193 | RCA |
| 523 | Programmable Read-only memory | 2732 | National Semiconductor |
| 524 | 2-input NAND | CD4011 | RCA |
| 525 | 2-input AND | CD4081 | RCA |
| 528 | Divide-by-223 | CD4068 CD4049 | RCA |
| 529 | Memory Control Logic (See Table 5) | | |
| 530 | Segment Counter | CD40163 | RCA |
| 532 | Segment Duration counter | " | |
| 531 | Divide-by-two | CD4013 | RCA |
| 535 | Oscillator | CD4049U | RCA |
| 536 | Hex Buffer | CD4050 | RCA |
| 537 | Push-to-talk switch | | |
| — | Switches $S_1$, $S_2$ and $S_3$ | CD4053 | RCA |

The following paragraphs describe the operation of the digital transmitter, the digital receiver, the digital transceiver and the memory control logic.

Figure 9:
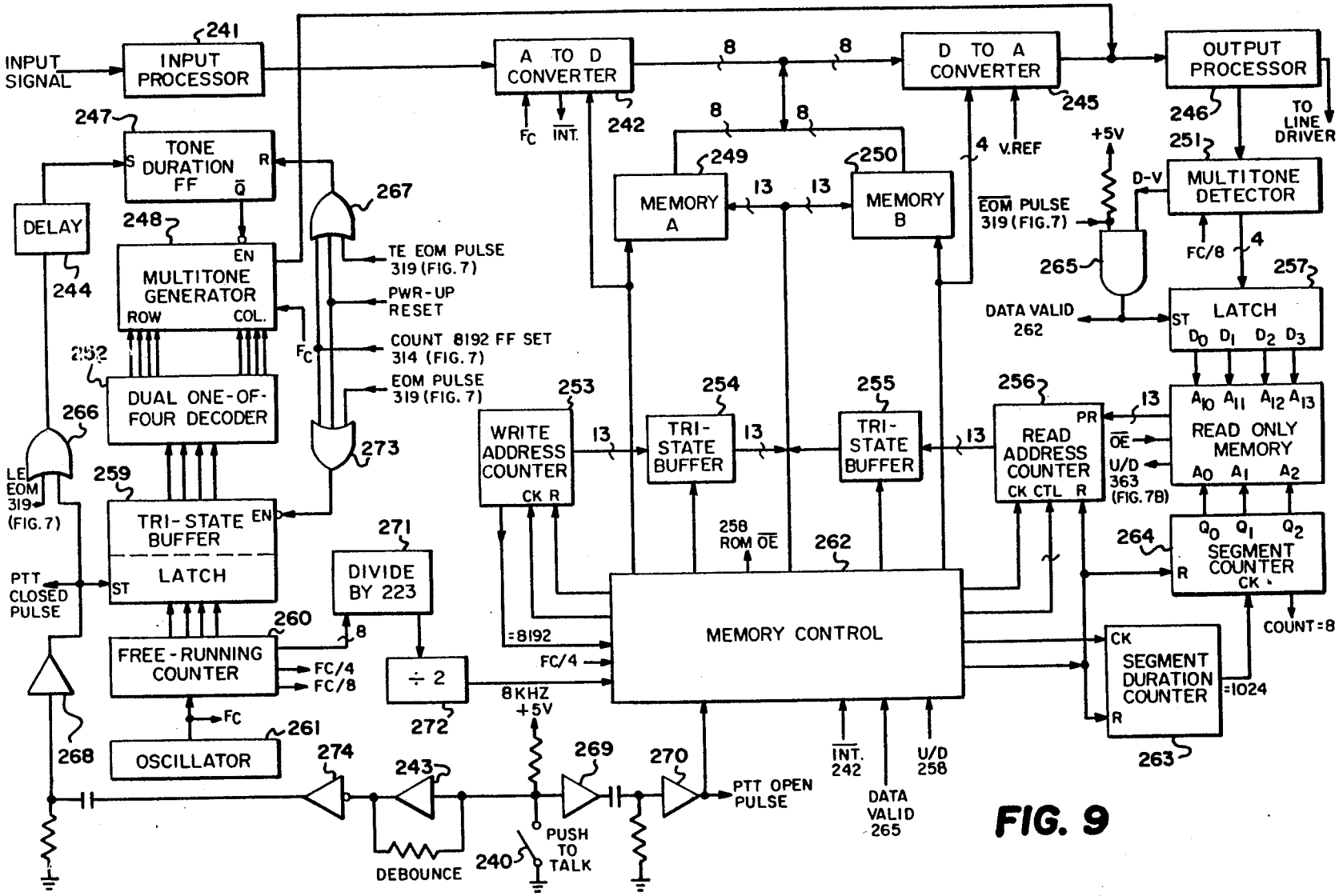
FIG. 9 is a schematic block diagram of a digital privacy transmitter.

Referring to FIG. 9, except where otherwise stated, when system power is turned "on", the various flip flops and counters in the digital transmitter of FIG. 9 assume random states. The system is initialized (the various flip flops, counters, etc. are forced into the required state) by a "power-up-reset pulse" generated from the positive-going edge of the logic power supply output. The "power-up-reset pulse" accomplishes the following:

(a) Tone duration flip flop 247 is reset to preclude generation of extraneous tones at the time the transmitter is turned "on".

(b) In memory control 262, flip flop 308 (FIG. 7) is set, designating that data will first be written into memory A 249.

(c) The various flip flops and counters controlling the generation of write addresses (FIG. 7A), read addresses (FIG. 7B and 7C), segment duration counter 263, and segment counter 264 are all reset.

When system power is turned "on" oscillator 261 starts generating a 3.579545 MHz signal. This signal is applied as a clock to free-running counter 260. It should be noted that free-running counter 260 is not reset by either the power-up-reset pulse or the data-valid pulse; hence, the pulses appearing at the four least significant bit outputs of free-running counter 260 at the instant of actuation of push-to-talk switch 240 are determined solely by the random timing of the switch closure. The four least-significant outputs of free-running counter 260 are applied to the inputs of latch/buffer 259. Several other control signals are derived by decoding the outputs of free-running counter 260:

(a) The divide-by-four output serves as a clock for many functions in memory control logic 262.

(b) The divide-by-eight output serves as a clock for multitone detector 251.

(c) The output of free-running counter 260 is divided-by 223 by element 271 to produce a 3.579545/223 signal which is further divided-by-two in element 272 to produce a clock signal having a frequency of approximately 8 kHz.

Still referring to FIG. 9, except where otherwise noted, closure of push-to-talk switch 240 generates a negative-going voltage edge. This edge is passed through debounce circuit 243 (a CMOS buffer with a suitable feedback resistor connected from its output to its input). Since the output of the buffer is of the same polarity as the applied voltage edge, any momentary bounce of the switch contacts (resulting in a series of voltage edges immediately after the original edge) will be ignored. The voltage edge at the output of debounce circuit 243 is inverted at 274 and is differentiated.

The above mentioned pulse is delayed at 244 and causes the bits at the four least-significant outputs of free-running counter 260 to be stored in latch 259. Since write address counter 253 was reset by the power-up-reset pulse, and write clock is not applied to write address counter 253 until the closure of push-to-talk switch 240, the count 8192 output of write address counter 253 will be zero; hence, the tri-state buffer portion of latch 259 is enabled and the bits at the four least-significant outputs of free-running counter 260 will appear at the inputs of dual one-of-four decoder 252. The two least-significant bits at the output of tri-state buffer portion of latch 259 are decoded and the decoded output is applied to the row inputs of multitone generator 248. The two most-significant bits at the output of buffer 259 are decoded and the decoded output is applied to the column inputs of multitone generator 248.

After a delay at 244 slightly greater than the propagation delay between setting latch 259 and the appearance of decoded signals at the row and column inputs of multitone generator 248 (thus assuring that the address inputs are settled), the pulse resulting from the closure of push-to-talk switch 240 sets tone duration flip flop 247. Immediately, multitone generator 248 produces a multitone signal whose frequencies are determined by the levels at the row and column inputs of multitone generator 248.

Figure 7:
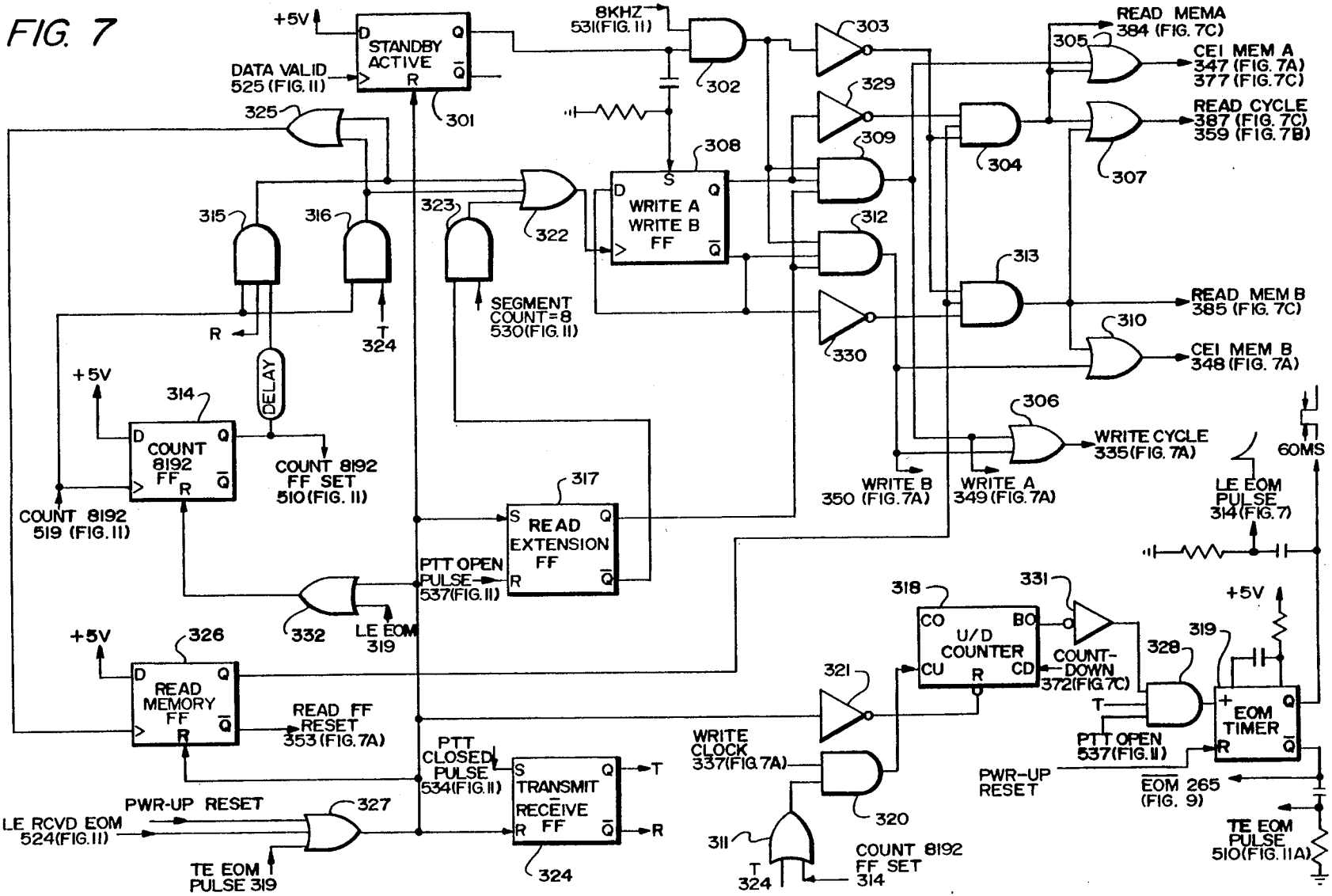
Figure 7A:
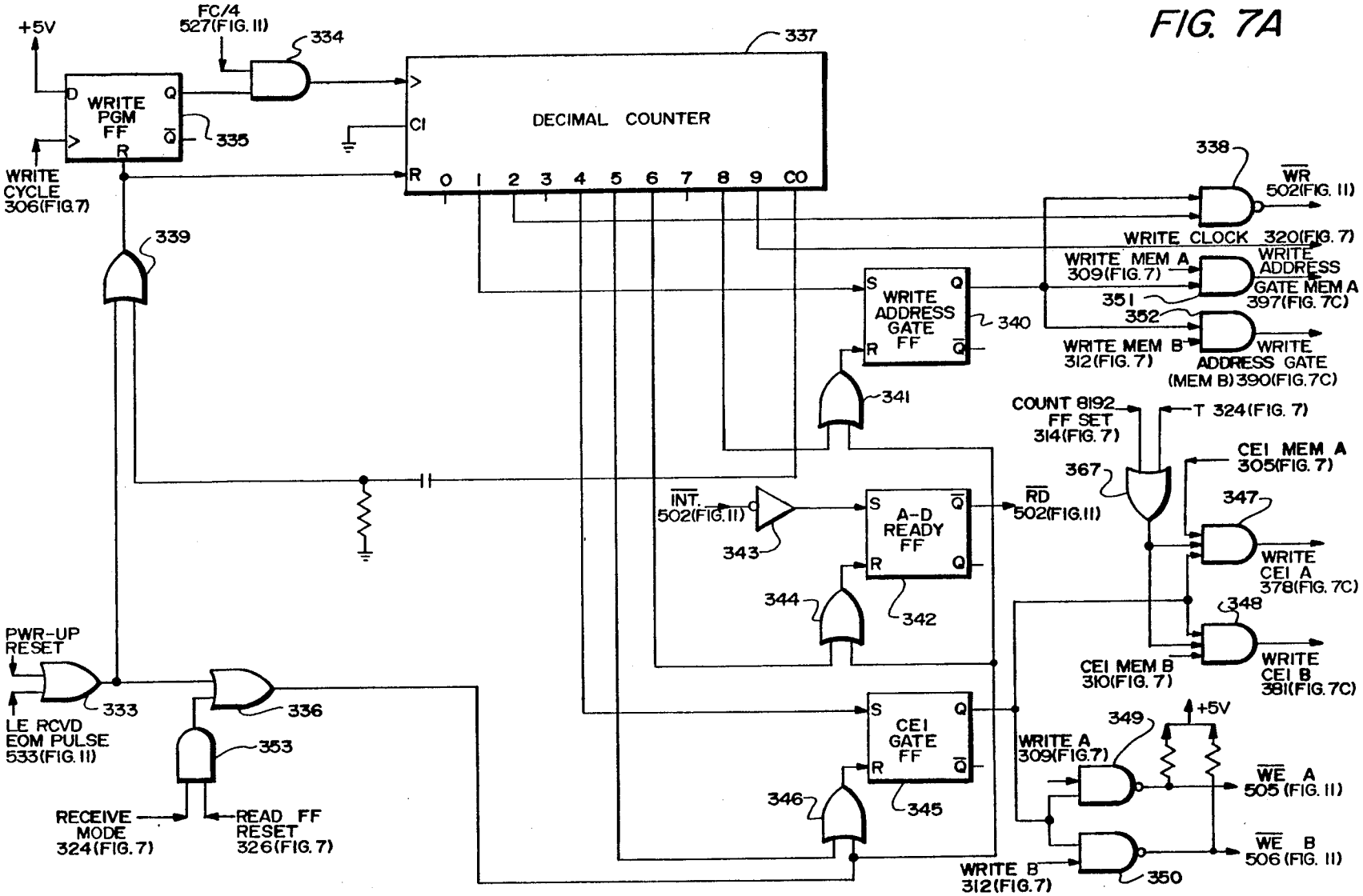
Figure 7B:
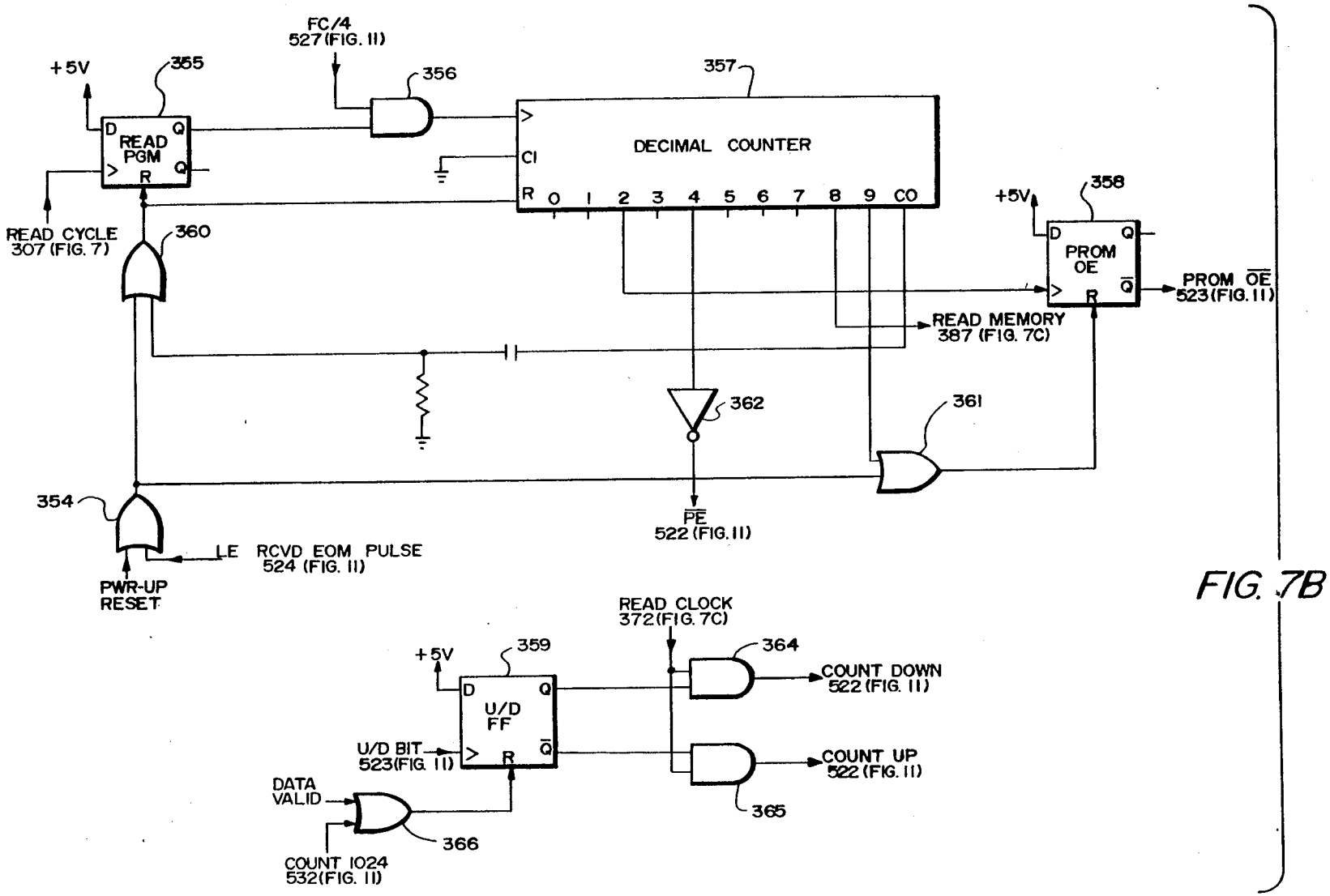
Figure 7C:
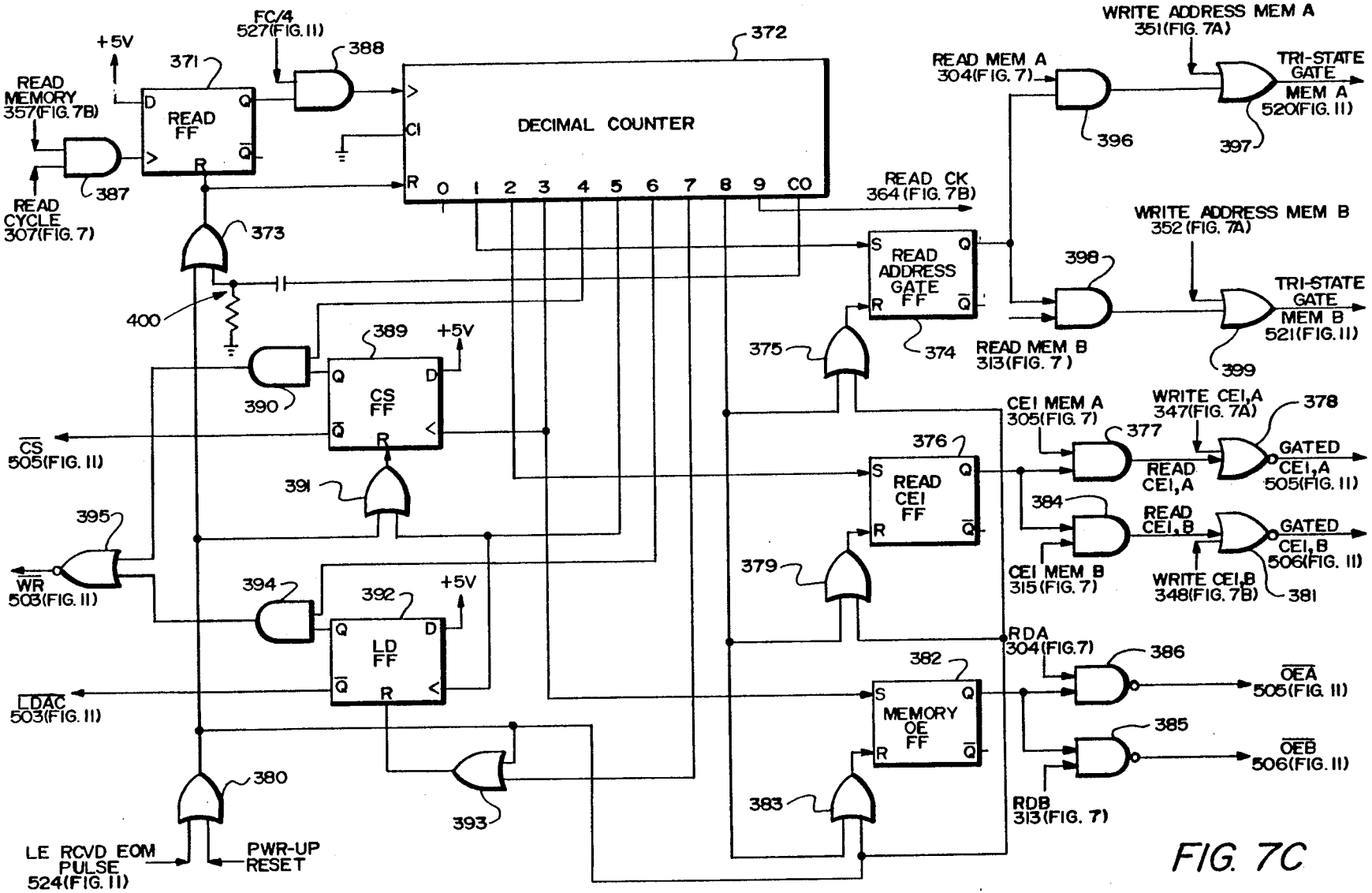

The multitone signal described in the preceding paragraph is fed, via output signal processor 246, to the input of multitone detector 251. Approximately 45 milliseconds after closure of push-to-talk switch 240, a set of four pulses identical to those pulses applied to the row and column inputs of multitone generator 248 appear at the output of multitone detector 251. Approximately 7 microseconds after the appearance of the four pulses, a data-valid signal appears at a second output of multitone detector 251. The leading edge of the data-valid signal causes the four bits appearing at the output of multitone detector 251 to be stored in latch 257, and sets stand-by/active flip flop 301 (FIG. 7) in memory control 262 (FIG. 9), thus causing analog-to-digital converter 242 to be enabled. The leading edge of the data-valid signal is differentiated and the resulting pulse is applied as a reset to:

Write Address counter 253,
Read Address counter 256,
Segment Duration counter 263,
Segment counter 264,
Divide-by-two 272 and
Up/down counter 359 (FIG. 7C).

The five last listed counters remain in reset until write address counter 253 reaches a count of 8192 (memory A is full and approximately one-second of the multitone signal has been sent to the receiver).

Referring still to FIG. 9, except where otherwise noted, the leading edge of the data-valid signal sets in motion a series of steps in memory control 262 which causes 8 kHz write clock pulses to be fed to write address counter 253. Write address counter 253 is incremented by each write clock pulse. The outputs of write address counter 253 are connected to the data inputs of tri-state buffer 254. As was previously noted, memory control logic causes the first page (one second, 8192 bytes of data) to be written into memory A 249 beginning immediately after push-to-talk switch 240 is closed.

When power to the digital transmitter is turned "on", input signal processor 241 begins to process the audio signal received from a microphone or other source. This signal is processed to remove noise spikes, the bandwidth of the incoming signal is limited to eliminate aliasing, and the amplitude of the signal is set to the level required at the input of analog-to-digital converter 242.

Early in the write portion of the 8 kHz clock cycle, analog-to-digital converter 242 is instructed to sample the incoming audio signal and to convert that sample to an eight bit digital word. After a short delay to let the information at the address inputs of memory A 249 settle, the output of analog-to-digital converter 242 is stored in memory A 249 by the application of a $\overline{WR}$ command to the $\overline{WR}$ input (not shown in FIG. 9) of memory A 249. At the start of the next write portion of the 8 kHz clock cycle, the process is repeated and the digital word representing the next sample of the incoming audio is stored in the second address location of memory A 249. This process continues until information is written into all 8192 memory locations or push-to-talk switch 240 is released.

Several things occur as a result of a count of 8192:

(a) Write address counter 253 is reset (b) Tone duration flip flop 247 is reset; hence, the multitone signal informing the receiver of which scrambling algorithm is in use is terminated.

(c) Write A/write B flip flop 308 (FIG. 7) in memory control 262 is toggled so that the next 8192 bytes of data will be stored in memory B 250.

Read address counter 256, segment duration counter 263 and segment counter 264 are inactive until memory A 249 is filled (a count 8192 output is generated by write address counter 253).

Read address counter 256 is set to the starting address in memory A 249 from which the first byte of data is to be read. The address in memory A from which the data is to be read is obtained from read-only memory 258 at the address pointed to by the four bits recovered from the multitone preamble to the message. As was previously mentioned, multitone detector 251 detects and decodes the multitone signal transmitted as a preamble to the message. These bits are stored in latch 257 from the time they are decoded until the end of the message is signalled by the release of push-to-talk switch 240.

One bit of data stored at each address in read-only memory 258 is a control bit which determines whether read address counter 256 is to count up or count down from the starting address to read the first segment of data from memory A 249. In this simplest embodiment of the digital transmitter, read address counter 256 would count up or count down [as instructed by the control bit ($D_c$) from the starting address specified in programmable read-only memory 258]. Segment duration counter 263 counts 1024 clock pulses (one segment duration) and advances segment counter 264. The new count at the output of segment counter 264 increments the address input to read-only memory 258 so that the next segment of data is read from the address in memory A 249 defined by the data at the newly specified address in read-only memory 258. As was the case in the first segment read out of memory, a control bit ($D_c$) in read-only memory 258 at the newly specified address will cause the data in memory A 249 to be read out in the forward (count up) or reverse (count down) order.

The above described process continues until eight segments have been read out of memory A 249. At this point, memory B 250 will have been filled so the system reconfigures itself to read the data stored in memory B 250 and to write data into memory A 249. The process of alternately writing into memory A 249 and then into memory B 250 while reading from the previously filled memory continues until push-to-talk switch 240 is released and all of the data stored in the memories has been transmitted. The output of digital-to-analog converter 245 is filtered to remove the quantizing noise in the reconstituted signal and to limit the bandwidth of the output signal to suit a voice-grade telephone circuit. Output signal processor 246 also has provision for setting the level of the output signal.

Release of push-to-talk switch 240 generates a pulse which causes memory control 262 to stop the flow of clock pulses to write address counter 253 and to disable analog-to-digital converter 242. In memory control 262, up/down counter 318 (FIG. 7) is incremented when a byte of data is written into memory and is decremented when a byte of data is read from memory. The pulse occurring at the release of push-to-talk switch 240 modifies the logic in memory control 262 so that no further data (only amplifier noise would be present) is digitized and stored in memory. The generation of read addresses and transmission of data continues until the last segment (or partial segment) of data is transmitted. As each byte of data is read out of memory, the up/down counter in memory control 262 is decremented. The design of the selected up/down counter 318 (FIG. 7, RCA type CD40193) is such that when the count is 000—00, attempting a further count down results in the generation of a "borrow" signal. The "borrow" signal is inverted at 331 (FIG. 7) and enables AND gate 328 (FIG. 7). Since the system is in the transmit mode (T is high), the presence of a "borrow" signal and the fact that push-to-talk switch 240 is released causes the output of said AND gate 328 to go high, thereby triggering EOM (end-of-message) timer 319 (FIG. 7) which generates an end-of-message command having a duration of sixty milliseconds (60 ms). The leading edge of the end-of-message command is applied to the set input of tone duration flip flop 247 via OR gate 266 and delay 244 (all in FIG. 9) causing the generation of a multitone signal representing the digital word 0000. This signal informs the receiving station that all data of a particular message has been transmitted; hence, the receiver is commanded to leave the receive mode and to return to the "standby" mode. This signal is generated in the following manner:

(a) Continuing in reference to FIG. 9, unless otherwise noted, the outputs of latch/buffer 259 are returned to ground by "pull-down" resistors (not shown in the diagram).

(b) At a write address counter 253 count of 8192, the low level present at the enable input of the tri-state buffer portion of latch/buffer 259 is replaced by a high level and the output of tri-state buffer 259 is a high impedance for the remainder of the message transmission.

(c) The leading edge of the EOM (end-of-message) signal sets tone duration flip flop 247 via OR gate 266 and delay 244. Setting tone duration flip flop 247 initiates the generation and transmission of a multitone signal signifying that all data constituting the particular message has been transmitted. It will be noted that the positive-going end-of-message pulse waveform is applied to the EN (enable) input of the tri-state buffer portion of latch/buffer 259 via OR gate 273 for the 60 millisecond duration of the end-of-message pulse thereby causing the output of latch/buffer 259 to present a high impedance (open circuit) to the inputs of dual one-of-four decoder 252.

(d) Since the four inputs to dual one-of-four decoder 252 are returned to ground through pull-down resistors, the inputs to multitone generator 248 are 0000; hence, the transmitted multitone signal will represent 0000.

(e) The inverted end-of-message signal present at the $\overline{Q}$ output of end-of-message timer 319 (FIG. 7) is applied to input of AND gate 265 (FIG. 9) thus blocking any action by the transmitter in response to the second data-valid signal. It should be noted that this circuit configuration does not preclude using 0000 to define a scrambling algorithm in normal system operation.

(f) The end-of-message multitone signal is terminated by the TE EOM (trailing-edge end-of-message) signal from EOM timer 319 (FIG. 7) via OR gate 267.

(g) At the termination of the end-of-message signal, the transmitter enters a "standby" mode and remains there until push-to-talk switch 240 is again depressed.

It should be noted that during a pause in a message (push-to-talk switch 240 is held down but no words are spoken) the random sounds picked up by the microphone will be transmitted.

The block diagram of the digital receiver (FIG. 10) presents the several functions performed in receiving and unscrambling a private digitized message. The following paragraphs describe the various functions which must be performed to recover a scrambled digital message.

Figure 10:
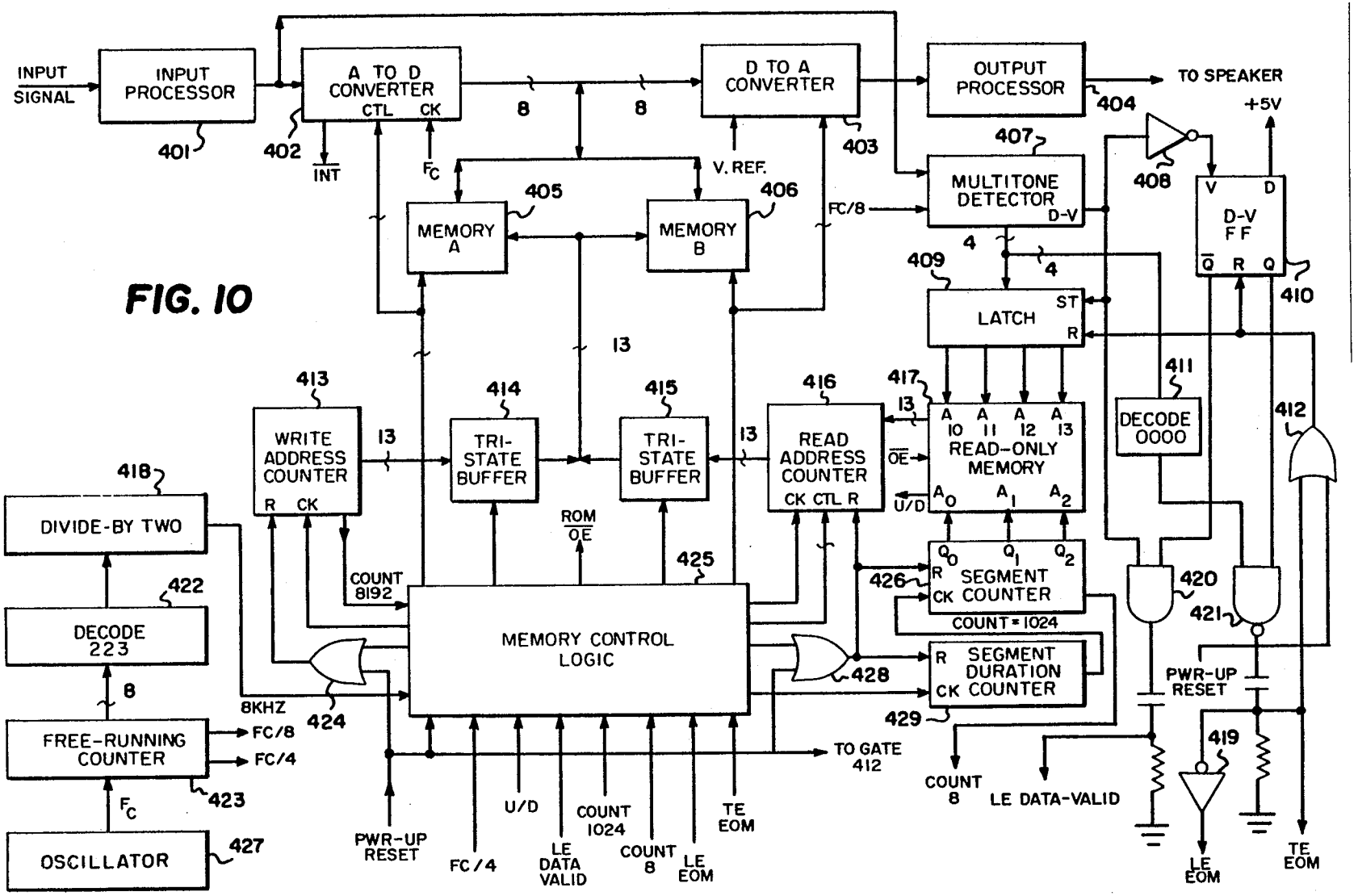
FIG. 10 is a schematic block diagram of a digital privacy receiver.

Proceeding in reference to FIG. 10, except where otherwise noted, a power-up-reset pulse is generated by differentiating the leading edge of the positive logic supply voltage. The power-up-reset pulse resets several flip flops in memory control 425. These flip flops inhibit operation of all counters other than free-running counter 423 by interrupting the flow of clock pulses to the counters.

Oscillator 427 starts at the instant power is turned "on" and continues to generate Fc pulses until power is turned "off". Free-running counter 423 generates Fc/4 and FC/8 clock pulses without interruption during the interval power is supplied to the receiver. Input processor 401 processes all signals appearing at its input during the interval receiver power is "on". However, no data is processed by analog-to-digital converter 402 while the receiver is in the "standby" mode (awaiting the arrival of a valid multitone signal). Approximately 45 milliseconds after the appearance of a valid multitone signal at the input of multitone detector 407, a four bit digital word identical to the word applied to the data inputs of multitone generator 248 in the digital transmitter (FIG. 9) will appear at the data outputs of multitone detector 407 (FIG. 10). Approximately seven microseconds after the appearance of the recovered data bits, a data-valid signal will appear at an output of multitone detector 407. The data-valid signal is applied to one input of AND gate 420. AND gate 420 is enabled by the $\overline{Q}$ output of data-valid flip flop 410. It will be remembered that data-valid flip flop 410 was reset by the power-up reset pulse or reception of an end-of-message signal (the $\overline{Q}$ output of a reset flip flop is at a logic high). The positive-going leading edge of the data-valid pulse appearing at the output of AND gate 420 is differentiated and the resulting pulse performs the following functions:

Resets write address counter 413,
Resets read address counter 416,
Resets segment duration counter 429,
Resets segment counter 426, and
Resets up/down flip flop 359 (FIG. 7B),
Resets divide-by-two 418.

It will be remembered that counters and flip flops come up in random states when power is applied to a digital system; hence, it is necessary to initialize the system (place all counters and flip flops in the required state) to begin operation. For this reason, the leading edge of the data-valid signal is applied to memory control 425. The leading edge of the data-valid signal is slightly delayed and performs the following functions in memory control 425:

(A) Enables the flow of clock pulses to write address counter 413. It will be remembered that in the digital transmitter, the multitone signal was terminated and the transmission of data was begun when 8192 bytes of data had been written in memory A 249 (FIG. 9).

(B) Inhibits the flow of control signals to analog-to-digital converter 402 (FIG. 10) so that no data is presented to the input of memory A 405 until 8192 write clock pulses have been counted by write address counter 413. (The end of this period coincides with the termination of the multitone preamble and the start of transmission of data from the digital transmitter).

(C) Inhibits the flow of addresses and control pulses to memory A 405 and memory B 406.

Occurrence of a count of 8192 by write address counter 413 initiates the following sequence of events:

(a) Enables generation of the clock and control pulses required to convert the data present at the output of input signal processor 401 to digital form and to write the data into memory A 405.

(b) Data is written into memory A 405 beginning at the lowest address (000 . . . 00) and incrementing the address one count for each byte of data written. As in the case of the digital transmitter, the 8 kHz clock cycle is divided into two equal periods to permit one write period and one read period during the 125 microsecond duration of each 8 kHz clock cycle.

Upon occurrence of the first write period of the 8 kHz clock, data is written into the first address in memory A 405. [Fc/4 pulses (895 kHz) serve as a clock for several functions in memory control 425. Fc/8 serves as a clock for multitone detector 407].

When memory A 405 is filled (8192 bytes of data), memory control 425 causes the data representing the incoming signal to be written into memory B 406. During the next read period of the 8 kHz clock, reading of data from memory A 405 is initiated. During the following write period of the 8 kHz clock cycle, data representing the incoming signal is written into memory B 406.

The process of writing data into memory B 406 and reading data from memory A 405 continues until memory B 406 is filled. Writing of data into one memory while reading data from the other memory continues for the duration of the incoming message. An up/down counter 318 (FIG. 7) in memory control 425 (FIG. 10) is incremented when a byte of data is written into memory and is decremented when a byte of information is read from memory; hence, reading of data from memory will continue for a maximum of one second after the last data is received.

This system cannot be permitted to enter the "standby" mode when the last byte of data is read from memory but must remain in the "active" receive mode until an end-of-message command (a multitone signal designating 0000) has been received. This system constraint is provided as it is quite possible that the person using the system may pause for several seconds between utterances.

Examination of the block diagram of the digital receiver (FIG. 10), reveals that the data-valid signal emanating from multitone detector 407 is inverted at 408 and is applied as a clock to data-valid flip flop 410. Since the data-valid signal is a positive-going pulse, the trailing edge of the inverted data-valid pulse sets said flip flop.

Data-valid flip flop 410 is reset by the power-up-reset pulse or the trailing edge of an end-of-message signal. Therefore, AND gate 420 is enabled at the time of occurrence of a first data-valid pulse and passes the leading edge of that data-valid pulse. Since data-valid flip flop 410 was set by the trailing edge of the first data-valid pulse, AND gate 420 is disabled (the $\overline{Q}$ output of data-valid flip flop 410 is low); hence, a second data-valid signal, without an end-of-message signal having been previously received, will not initialize the system for reception of a message. This arrangement permits the use of the multitone signal representing 0000 as a message preamble as well as an end-of-message command.

As was previously mentioned, the data representing the incoming signal is written into memory in the order in which it is received. Storage of data starts at address zero and write address counter 413 (FIG. 10) is incremented as each byte of data is written into memory. This organization of data dictates that the data be read from memory in an order prescribed by an unscrambling algorithm defined by the received multitone preamble of the current message. This algorithm will restore the scrambled message segments to the proper sequence. In the digital transmitter (FIG. 9), closure of push-to-talk switch 240 (FIG. 9) caused the bits present at the four least-significant outputs of free-running counter 260 (FIG. 9) to be stored in latch 259 (FIG. 9) and a pair of tones determined by these four bits were generated by multitone generator 247 (FIG. 9). This multitone signal was detected and decoded by multitone detector 251 (FIG. 9). The resulting four bit digital word was used to select a particular scrambling algorithm from transmit read-only memory 258 (FIG. 9). The above mentioned multitone signal was transmitted to the digital receiver (FIG. 10), and was detected and decoded by receiver multitone detector 407. Four bits, identical to those which programmed multitone generator 247 in the digital transmitter (FIG. 9), appear at the output of receiver's multitone detector 407 (FIG. 10). The leading edge of the accompanying data-valid signal at an output of multitone detector 407 (FIG. 10) causes these bits to be stored in latch 409.

Continuing in reference to FIG. 10, except where otherwise noted, the four recovered data bits are applied to address inputs of read-only memory 417. Since segment counter 426 was reset by the leading edge of the data-valid signal via memory control logic 425 and OR gate 428, all zeros will appear at the data outputs of segment counter 426. These bits are connected to the three least-significant address inputs of read-only memory 417. The address in read-only memory 417 defining the starting address in memory A 405 from which the first byte of the first segment is to be read is defined by the four bits recovered from the received multitone signal.

The data space at each address in read-only memory 417 is eight bits wide; however, only three of these bit locations are used as address information. A fourth bit at every address determines whether a segment is to be read in a forward direction (that is, the way the original segment of information was spoken) or in the reverse direction (that is, the reverse of the way in which the segment of information was spoken). To simplify system design, the following convention is chosen:

1 = count down (read out the data in the particular segment in the reverse of the order in which the segment of information was spoken);

0 = count up (read the data in the particular segment in the order in which it was spoken).

In this simplest implementation of the system, segment duration counter 429 is incremented as each byte of data is read from memory. Segment duration counter 429 produces an output at a count of 1024 bytes thereby incrementing segment counter 426. Incrementing segment counter 426 advances the address input of read-only memory 417 to the address from which the next segment of data is to be read. Incrementing segment counter 426 continues until eight segments of data have been read from memory. When a count of eight is reached, the counter is reset, and counting is resumed.

At the end of a message, or at a pause in the message, reading of data from memory continues until up/down counter 318 (FIG. 7) in memory control generates a "borrow" signal. This indicates that all data has been read from memory.

Examination of the digital transceiver block diagram (FIG. 11) reveals that the transceiver includes apparatus identical to the transmitter with the addition of three single-pole, double-throw switches ($S_1$, $S_2$, and $S_3$ which are controlled by push-to-talk switch 537 and may be mechanically ganged therewith), and the inclusion of the algorithms required for the recovery of the intelligence of the received scrambled message and the end-of-message processing circuitry of the digital receiver (FIG. 10).

Figure 11A:
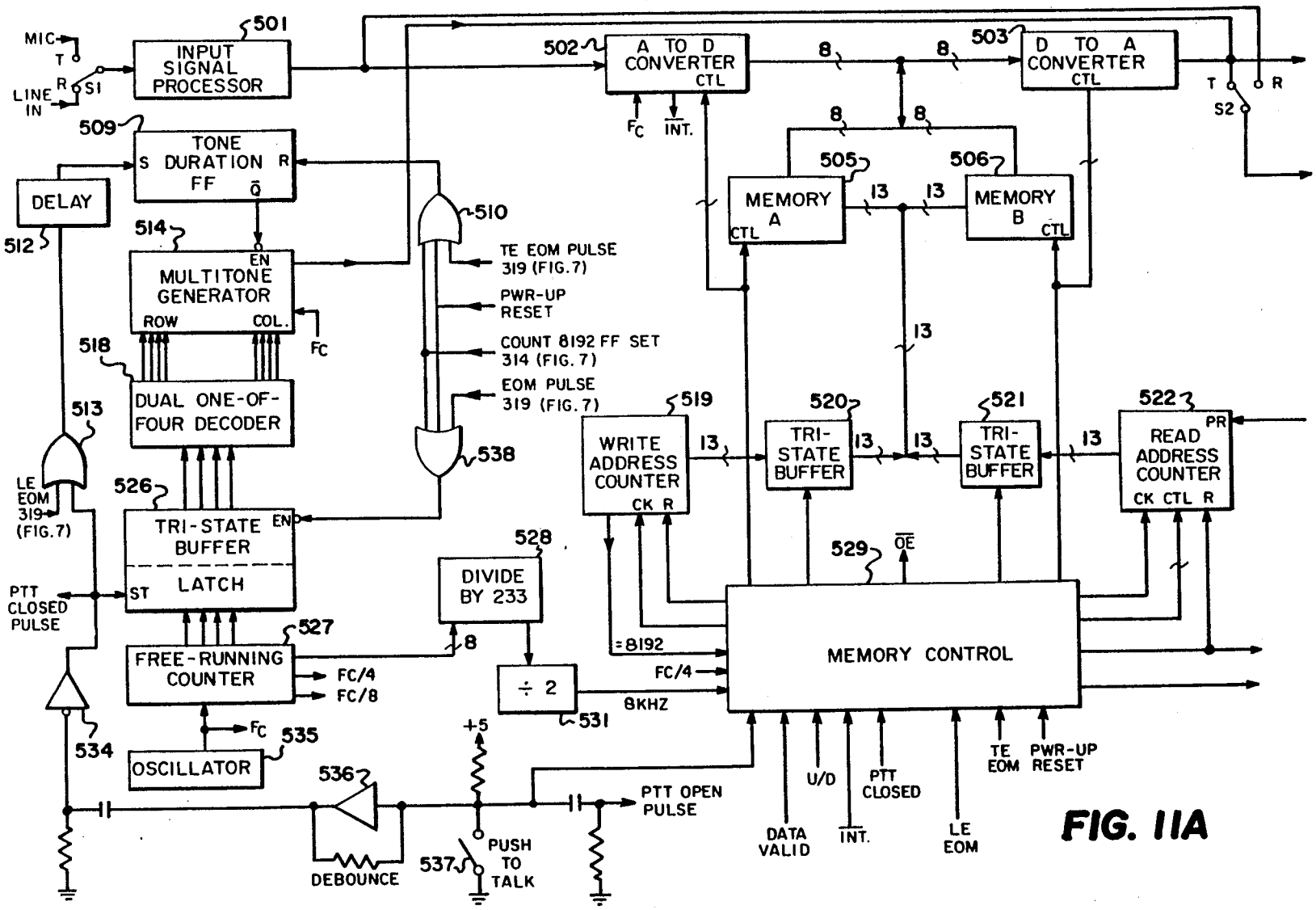
FIGS. 11A and 11B, together, show a schematic block diagram of a digital privacy transceiver.
Figure 11B:
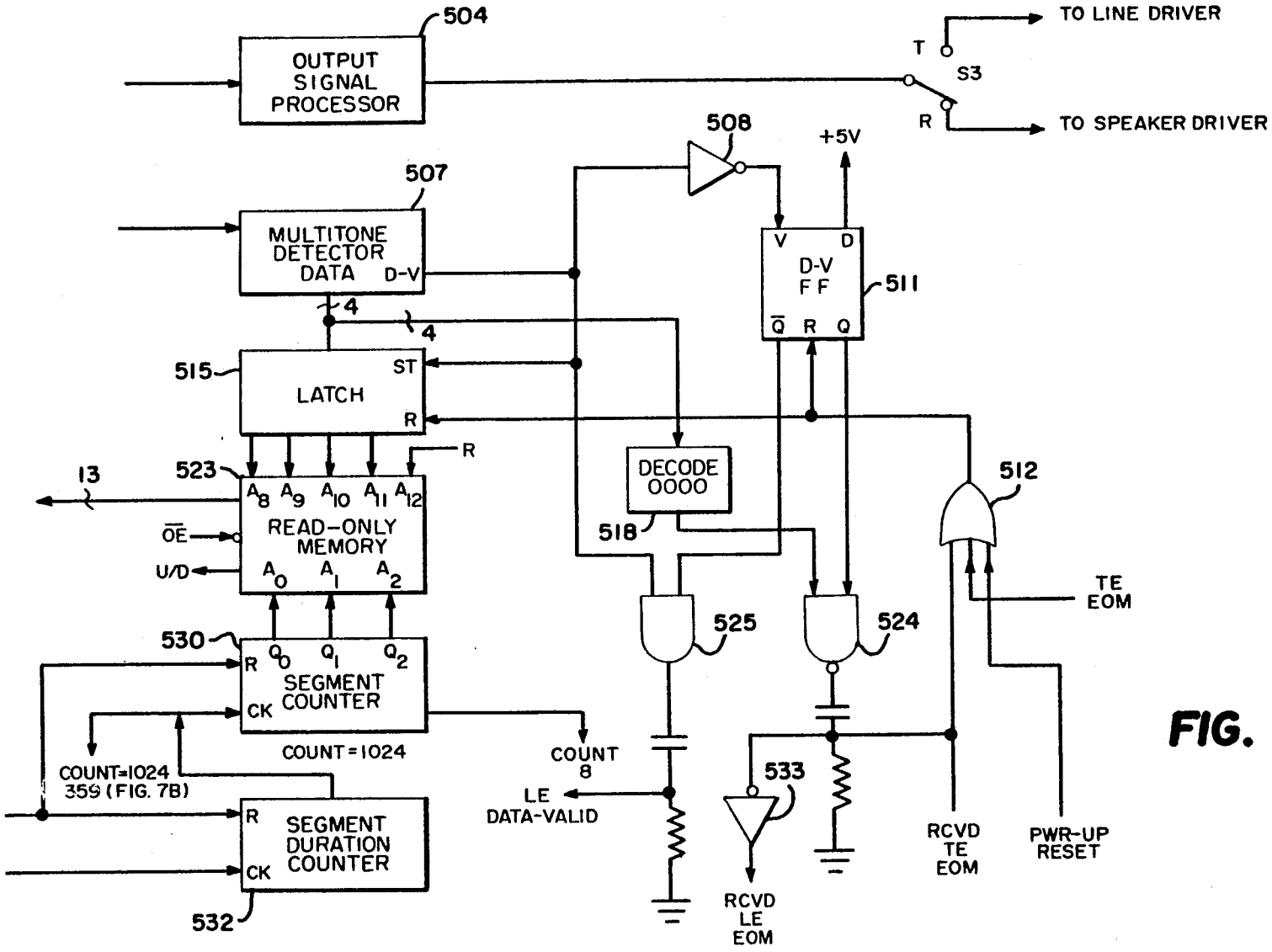

Referring to FIG. 11, (which comprises FIGS. 11A and 11B, taken together), except where otherwise indicated, the transceiver control logic is so arranged that when system power is turned "on" the system always enters the R (receive) mode. Depressing push-to-talk switch 537 causes the three switches (these switches may be solid-state or they may be implemented as contacts of relays) to enter the T (transmit) mode.

In the R (receive) mode, the three switches perform the following functions:

$S_1$ selects the signal source designated "line in" in anticipation of receiving a message from a compatible privacy transmitter; All received signals are passed through input processor 501 to remove any voltage spikes which might damage the circuitry, remove any out-of-band signals and set the amplitude of the incoming signal at a level compatible with the requirements of A to D converter 502;

$S_2$ causes information from input signal processor 501 to be fed to the input of multitone detector 507; and $S_3$ causes the signal from output signal processor 504 to be fed to an amplifier driving headphones or a speaker to convert the signal to an audible form.

In the transmit (T) mode, the three switches perform the following functions:

$S_1$ causes the signal from the originating source, such as a microphone, to be fed to input signal processor 501;

$S_2$ selects the signal from multitone generator 514 as the input for multitone detector 507. A signal is present at the output of multitone generator 514 only during the one-second message preamble.

$S_3$ causes the signal developed by output processor 504 to be fed to a communication link via a "line driver".

Continuing in reference to FIG. 11, except where otherwise noted, while in the receive mode, the presence of a valid multitone signal at the input of multitone detector 507 for at least 45 milliseconds causes four bits to appear at outputs of multitone detector 507 and after an additional 7 microseconds, a data-valid signal appears at a further output of multitone detector 507. The data-valid signal performs the following functions:

The leading edge of the data-valid signal causes the four data-bits recovered from the transmitted multitone signal to be stored in quad latch 515. The leading edge of the data-valid signal is differentiated and the resulting pulse:

Resets write address counter 519,
Resets read address counter 522,
Resets segment duration counter 532,
Resets segment counter 530 and
Resets divide-by-two 531.

In memory control 529 [memory control being discussed more fully in a later section], various control flip flops are set by the leading edge of the data-valid pulse so that write clock pulses are fed to write address counter 519. Thus, measurement of the period from the time of arrival of the data-valid pulse to the start of transmission of scrambled data (8192 clock pulses, approximately one-second later) is facilitated. Since the transceiver is in the receive mode, data is not written into memory during this period as the flow of control pulses to memory A 505 is inhibited. At the end of the one-second message preamble, the incoming message signal is converted into eight-bit digital words by A to D converter 502 and is written into memory A 505 in the order in which the data is received, starting at memory location zero.

When 8192 bytes of information have been written into memory A 505, write A/write B flip flop 308 (FIG. 7) in memory control 529 (FIG. 11) is toggled so that the next 8192 bytes of data are written into memory B 506. This write A/write/B sequence continues until all incoming data is written into memory.

It will be recalled that the process leading to the writing of data into memory was started by the leading edge of the data-valid pulse at an output of multitone detector 507. The four data bits recovered from the multitone signal (identical to those determining the particular multitone signal transmitted as a message preamble) are stored in latch 515.

The four bits are applied to address inputs ($A_8$, $A_9$, $A_{10}$ and $A_{11}$) of read-only memory 523.

The three outputs of segment counter 530 are connected to the least significant address inputs of read-only memory 523.

Since segment counter 530 was reset by the leading edge of the data-valid pulse and no clock pulses have been fed to segment counter 530, the three outputs will all be zero; Hence, the four bits recovered from the multitone signal transmitted as a preamble to the received scrambled message will determine the location in read-only memory 523 from which the starting address in memory A 505 for recovery of the first segment of data is to be read.

The bytes of data stored at each address in read-only memory 523 are eight bits wide; however, only three of these bits are connected to the present inputs of read address counter 522.

A fourth bit at every memory location defines the direction in which read address counter 522 will count. That is, if the fourth bit is a 1 (one) read address counter 522 will be decremented from the starting address by a read clock pulse. Similarly, if the fourth bit is a 0 (zero) read address counter 522 will be incremented by a read clock pulse.

Segment duration counter 532 is incremented when a byte of data is read from memory and produces an output when 1024 bytes (one segment) of data have been read. This output clocks segment counter 530. The three data outputs of segment counter 530 are connected to the three least significant address inputs of read-only memory 523.

Segment counter 530 generates an output signal when eight segments of information have been read from memory. This signal is used at the end of a transmission to continue reading data from memory until the last byte of data has been read.

As each byte of data is read from memory, it is converted to analog form by digital-to-analog converter 503. Quantizing noise is removed from the recovered analog signal by a low-pass filter in output signal processor 504. Output signal processor 504 also amplifies the recovered signal to a level suitable for driving a speaker or a headset. It should be noted that in the present configuration, the transceiver system will remain in the receive mode until the last byte of data has been read from memory and an "end-of-message" multitone signal has been received. The system described automatically returns to the "standby" mode upon receipt of an end-of-message signal and completion of reading data stored in memory.

Whether the transceiver is in the receive or standby mode, closure of push-to-talk switch 537 will cause the system to enter the transmit mode. Closure of push-to-talk switch 537 results in the following:

(a) Switches $S_1$, $S_2$, and $S_3$ are placed in the T (transmit) position;

(b) The bits then present at the four least-significant outputs of free-running counter 527 are stored in latch 526; and (c) In memory control 529 the circuitry is reconfigured to afford a transmitting capability.

Further, during the first second after closure of push-to-talk switch 537, the tri-state buffer portion of latch 526 is enabled; hence, the four bits stored in latch 526 appear as inputs to dual one-of-four decoder 518. One section of said dual one-of-four decoder 515 decodes the two least-significant bits from latch 526 and the decoded output is applied to the row inputs of multitone generator 514. The second section of dual one-of-four decoder 518 decodes the two most-significant bits from latch 526 and the decoded output is applied to the column inputs of multitone generator 514. A flip flop 324 (FIG. 7) in memory control 529 is set to place the system in the transmit mode.

Continuing in reference to FIG. 11, except where otherwise noted, a delay at 512 slightly longer than the propagation delay through latch 526 and dual one-of-four decoder 518 is in the path of the pulse derived from the closure of push-to-talk switch 537. Hence, the bits present at the row and column inputs of multitone generator 514 will have settled before tone duration flip flop 509 is set by the pulse resulting from the closure of push-to-talk switch 537.

Setting tone duration flip flop 509 enables multitone generator 514. The output of multitone generator 514 is a multitone signal defined by the four bits randomly latched at the four least-significant outputs of free-running counter 527.

The resulting multitone signal is fed via switch $S_3$ to the line driver where the signal is amplified and processed to suit the specifications of the transmission medium (radio link, telephone circuit, etc.). A sample of the transmitted multitone signal is fed to multitone detector 507 via switch $S_2$.

Approximately 45 milliseconds after the start of transmission of the multitone signal, four bits identical to those latched at the output of free-running counter 527 appear at the data outputs of multitone detector 507. Approximately 7 microseconds after the appearance of the data output, a data-valid signal appears at a further output of multitone detector 507 and causes the four bits to be stored in latch 515. The leading edge of the data-valid signal is differentiated and the resulting pulse:

(a) Sets transmit/receive flip flop 324 (FIG. 7) in memory control 529 indicating that the system is to operate in the transmit mode;

(b) Resets the following counters:

Write address counter 519,

Read address counter 522,

Segment duration counter 532,

Segment counter 530,

Divide-by-two 531; and

Up/down flip flop 359 (FIG. 7B);

(c) Enables the flow of clock pulses to write address counter 519; and (d) Strobes the recovered data bits into latch 515.

During the first second after recognition of a valid multitone signal, clock pulses are fed to write address counter, 519, A to D converter 502 is enabled and data is written into memory A 505.

At the end of the first second of signal storage:

(a) Transmission of the multitone signal is terminated.

(b) Writing of data into memory B 506 is initiated and writing of data into memory A 505 is terminated.

(c) The four bits of data stored in latch 515 are applied to address inputs of read-only memory 523. Data stored at the particular address in read-only memory 523 specifies the address in memory A 505 from which the first byte of the first segment of the message is to be read. The data stored at that particular address in read-only memory 523 also specifies whether read address counter 522 is to be incremented or decremented during the reading of the particular segment of the stored message.

(d) The trailing edge of the data-valid pulse sets data-valid flip flop 511 via inverter 508.

Upon completion of reading all of the data stored in memory A 505, reading of the data stored in memory B 506 is begun and writing of the next received data into memory A is started. The process of alternately writing data into and reading data from each of the two memories continues until push-to-talk switch 537 is released.

The reading of data from memory continues after the release of push-to-talk switch 537 until memory control 529 signals that the last byte of data has been read from memory. When the last byte of data has been read from memory, memory control 529 generates an "end-of-message" pulse having a duration of 60 milliseconds. Since the system is in the transmit mode, the leading edge the "end-of-message" pulse generated by memory control logic 529 enables tone duration flip flop 509 via OR gate 513 and delay 512.

Release of push-to-talk switch 537 also resets count 8192 flip flop 314 (FIG. 7) in memory control 529; hence, the tri-state buffer portion of latch 526 is enabled. However, the EOM (end-of-message) pulse 319 (FIG. 7) is applied to the EN (enable) input of tri-state buffer $\phi$ portion of latch 526 via OR gate 538 for the 60 millisecond duration of the EOM (end-of-message) pulse. Thus, the tri-state buffer portion of latch 526 remains disabled for the duration of the EOM command. Under these conditions, the output of the tri-state buffer portion of latch 526 is a high impedance. The inputs of dual one-of-four decoder 518 are returned to ground by pull-down resistors (not shown on the block diagram); hence, the output of multitone generator 514 will represent the digital word 0000. (the selected "end-of-message" signal). The "end-of-message" signal will be terminated by the trailing edge of the "end-of-message" pulse generated in memory control 529.

Since the system was still in the transmit mode when the transmission of the "end-of-message" signal was initiated, the resulting multitone signal will be fed to multitone detector 507 via switch $S_2$. Multitone detector 507 will recover four bits (0000) and a data-valid signal. As will be remembered, data-valid flip flop 511 was set by the trailing edge of the data-valid signal resulting from detecting and decoding of the multitone preamble to the message just transmitted; hence, AND gate 525 is disabled by the presence of the low level at the $\overline{Q}$ output of data-valid flip flop 511. This circuit configuration assures that a second data-valid pulse will not cause generation of erroneous signals. The output of "end-of-message" detector 516 is passed by NAND gate 524 and the "received-end-of-message" pulses are generated as shown. The leading edge of the "received-end-of-message" pulse is not used in the transmit mode. The trailing edge of the "received-end-of-message" pulse performs the following functions:

(a) Resets data-valid flip flop 511;

(b) Resets receive/transmit flip flop 324 (FIG. 7) in memory control 529 leaving the transceiver in the receive mode; and (c) Resets standby/active flip flop 301 (FIG. 7) in memory control 529 leaving the system in the standby mode.

At this point, the transceiver will enter the active/-receive mode upon receipt of a valid multitone signal or will enter the transmit mode upon closure of push-to-talk switch 537.

MEMORY CONTROL LOGIC

The explanation of memory control logic functions will be discussed relative to the transceiver of FIGS. 11A and 11B, collectively referred to as "FIG. 11". Memory control logic 529 is so designed that when power is turned on or an assigned function (transmit a message or receive a message) is completed the system enters the "standby" mode with all flip flops and counters in the proper inital configuration.

Closure of push-to-talk switch 537 signals that the system is to operate in the transmit mode. On the other hand, reception of a valid multitone signal from a remote transmitter while the transceiver is in the "standby" mode will cause the transceiver to operate in the receive mode until an "end-of-message" multitone signal is received and will then return to the standby mode.

The following paragraphs will discuss the operation of the transceiver memory control logic 529 (FIG. 11) in detail. It should be mentioned that the information supplied is equally applicable to either the stand-alone transmitter or receiver.

OPERATION OF MEMORY CONTROL LOGIC IN THE TRANSMIT MODE

In the following description, references will be to FIG. 11, (comprised of FIG. 11A and FIG. 11B, together), except where otherwise noted. Closure of push-to-talk switch 537 results in the following:

(a) Transmit/receive flip flop 324 (FIG. 7) is set to place the transceiver in the transmit (T) mode. Setting transmit/receive flip flop 324 results in the following actions:

(i) Switch $S_1$ is placed in the transmit (T) position so that the message signal (from a microphone or other signal source) is fed to input signal processor 501.

(ii) Switch $S_2$ is placed in the transmit (T) position causing the multitone signal produced by multitone generator 514 to be fed to the input of multitone detector 507.

(iii) Switch $S_3$ connects the signal from output signal processor 504 to the chosen transmission medium.

(b) The four least-significant bits present at the output of free-running counter 527 are strobed into latch 526 by the pulse resulting from the closure of push-to-talk switch 537.

(c) The four above mentioned least-significant bits are connected to the inputs of dual one-of-four decoder 518 until count 8192 flip flop 314 (FIG. 7) is set to remove the low level from the tri-state enable input of latch 526.

(d) The pulse resulting from the closure of push-to-talk switch 537 is inverted at 534 and delayed at 512 for a period slightly greater than the propagation delay through latch 526 and dual one-of-four decoder 518 so that the data at the row and column inputs of multitone generator 514 is settled before tone duration flip flop 509 is set. This enables the generation of a multitone signal defined by the four random bits latched at the output of free-running counter 527. Multitone detector 507 recovers four bits identical to those captured by latch 526 approximately 45 milliseconds after the start of the multitone signal. Approximately 7 microseconds after the appearance of the four bits at the output of multitone detector 507, a data-valid signal appears at a further output of multitone detector 507. The data-valid signal strobes latch 515 to store the four bits present at the output of multitone detector 507. These bits will be used as address inputs for read-only memory 523.

The data-valid signal present at the output of multitone detector 507 is passed by AND gate 525 which is enabled by the $\overline{Q}$ output of data-valid flip flop 511. The output of AND gate 525 is differentiated and the resulting pulse performs the following functions:

(a) Sets standby/active flip flop 301 (FIG. 7). Setting this flip flop results in the following actions:

(i) Write A/write B flip flop 308 (FIG. 7) is set. This action forces the writing of the first 8192 bytes of data into memory A 505.

(ii) AND gate 302 (FIG. 7) is enabled. Enabling AND gate 302 starts the flow of 8 kHz clock pulses 531 (FIG. 11) to memory control logic 529 (FIG. 11).

The trailing edge of the data-valid signal sets data-valid flip flop 511. (In the receive mode, setting said data-valid flip flop 511 with the trailing edge of the first-received data-valid signal prevents a second valid multitone signal [without an intervening end-of-message signal] from interrupting reception of a message by causing the receiver to start over with a new unscrambling algorithm).

As was mentioned earlier, setting standby/active flip flop 301 (FIG. 7) enables the flow of 8 kHz clock pulses (waveform A, FIG. 8) to various write and read control circuits. Since write A/write B flip flop 308 (FIG. 7) was set (forced into the write A state) when standby/active flip flop 301 (FIG. 7) was set by the leading edge of the data-valid pulse, AND gate 309 (FIG. 7) was enabled. Enabling AND gate 309 results in a flow of 8 kHz clock pulses during the write portion of the 8 kHz clock signal. The output of AND gate 309 produces a write A output and a write cycle command at the output of OR gate 306.

The write cycle command is applied to the clock input of write program flip flop 335 (FIG. 7A). The positive-going edge of the write cycle command sets write program flip flop 335 and, since the Q output of write program flip flop 335 enables AND gate 334, the flow of Fc/4 clock pulses (approximately 895 kHz repetition rate) to decimal counter 337 (FIG. 7A) is initiated.

Output 1 of decimal counter 337 (FIG. 7A) sets write address gate flip flop 340 (FIG. 7A). The output of said flip flop 340 is combined with the write memory A command 309 (FIG. 7) by AND gate 351 (FIG. 7A) to generate write address gate waveform memory A 505 (FIG. 11). This gate pulse is combined with the read address gate waveform memory A 505 by OR gate 397 (FIG. 7C) to enable tri-state address buffer 520 (FIG. 11) when data is to be written into or read from memory A 505 (FIG. 11). In like manner, the output of write address flip flop 340 (FIG. 7A) is combined with the write memory B command by AND gate 352 (FIG. 7A). The resulting gate signal is combined with read address gate 398 (FIG. 7C) by OR gate 399 (FIG. 7C)

to form the read/write address gate controlling tri-state address buffer B 521 (FIG. 11).

Output 8 of decimal counter 337 (FIG. 7A) resets write address gate flip flop 340 (FIG. 7A). The resulting address gate (waveform B, FIG. 8) starts before any data is present at the input of memory A 505 (FIG. 11) and ends after the completion of writing data into memory A 505. This arrangement assures that the memory address inputs are stable during the period data is being written into memory.

Output 2 of decimal counter 337 (FIG. 7A) is fed to an input of NAND gate 338 (FIG. 7A). Since NAND gate 338 is enabled by setting write address flip flop 340 (FIG. 7A), the output of said NAND gate 338 forms the $\overline{WR}$ pulse (waveform C, FIG. 8) for A- to -D converter 502 (FIG. 11). The negative-going edge of the $\overline{WR}$ pulse initiates sampling of the incoming message signal and the positive-going edge of the $\overline{WR}$ pulse initiates conversion of the sample to a byte of digital data.

Approximately 600 nanoseconds after the trailing edge of the $\overline{WR}$ pulse, conversion of the sample to digital form is completed. Upon completion of the conversion, A-to-D coverter 502 (FIG. 11) generates an $\overline{INT}$ (interrupt) pulse. The $\overline{INT}$ pulse (waveform D, FIG. 8) is inverted at 343 (FIG. 7A) and sets A-to-D ready flip flop 342 (FIG. 7A). The $\overline{Q}$ output of said A-to-D ready flip flop 342 forms a $\overline{RD}$ pulse (waveform E, FIG. 8). Said $\overline{RD}$ pulse enables the tri-state output of A-to-D converter 502 (FIG. 11) so that the byte of data resulting from the conversion of the message sample to digital form appears on the data bus at the data inputs of both memory A 505 and memory B 506 (both appear in FIG. 11). It will be noted that A-to-D ready flip flop 342 (FIG. 7A) is reset by output 6 of decimal counter 337 (FIG. 7A). This timing assures that the data from A-to-D converter 502 is present at the data input of the selected memory until the write cycle for that particular byte of data is completed.

Figure 8:
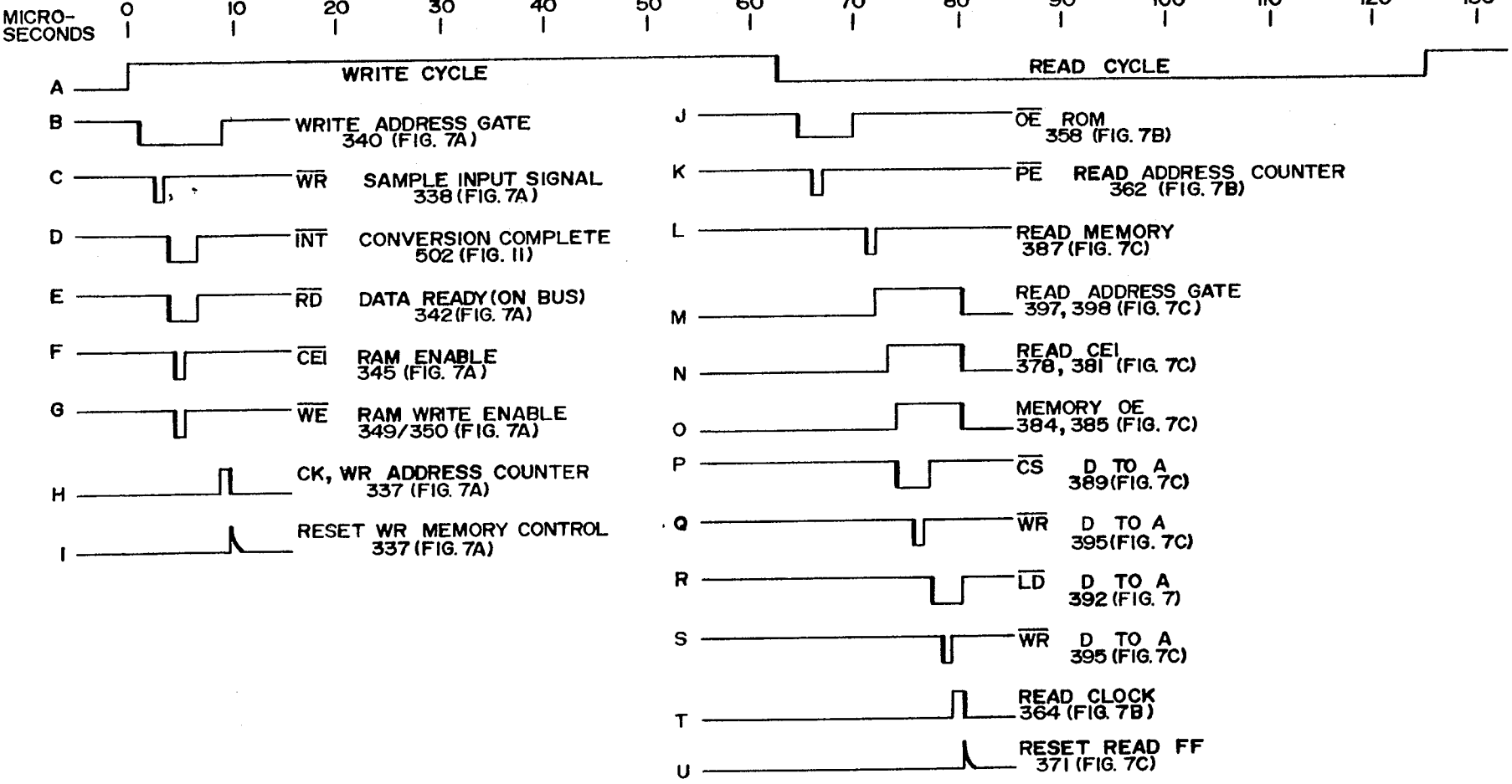
FIG. 8 is a timing diagram showing the critical waveforms of the memory control logic.

Output 4 of decimal counter 337 (FIG. 7A) sets $\overline{CE1}$ (chip enable 1) gate flip flop 345 to generate $\overline{CE1}$ (waveform F, FIG. 8) and $\overline{WE}$ (write enable) gate (waveform G, FIG. 8). It will be noted that CE1 and $\overline{WE}$ are coincident; this is permissible as both pulses must be present to cause data to be written into memory. The CE1 pulse is steered to memory A 505 (FIG. 11) by AND gate 347 (FIG. 7A) using CE1 memory A 305 (FIG. 7) as the control signal. In a similar manner, NAND gate 349 (FIG. 7A) steers WE (write enable) A signal 309 (FIG. 7) to memory A 505 (FIG. 11).

Output 9 of decimal counter 337 (FIG. 7A) serves as a count-up clock for up/down counter 318 (FIG. 7). The "carry" (CO) output of decimal counter 337 is differentiated and the resulting waveform (waveform I, FIG. 8) resets write program flip flop 335 and decimal counter 337 via OR gate 339.

It will be noted that only one byte of data is written into memory during a given 8 kHz clock cycle. Also, the sequence of actions described in the preceding paragraphs continues without reading data from memory until 8192 bytes of data have been written into memory A 505 (FIG. 11). When 8192 bytes of data have been written into memory A 505, a pulse is generated by write address counter 519 (FIG. 11). This pulse accomplishes the following:

Since the system is in the transmit (T) mode, AND gate 316 (FIG. 7) is enabled; hence, write A/write B flip flop 308 (FIG. 7) is toggled via OR gate 322 into the write B mode. On the next 8 kHz clock cycle, data will be written into memory B 506 (FIG. 11).

When count 8192 flip flop 314 (FIG. 7) is set, the resulting high level at the Q output of count 8192 flip flop 314 resets tone duration flip flop 509 (FIG. 11) via OR gate 510 (FIG. 11), thereby terminating the transmission of the multitone message preamble. In the transmit (T) mode, read memory flip flop 326 (FIG. 7) is set by the count 8192 pulse via AND gate 316 and OR gate 325. Setting read memory flip flop 326 (FIG. 7) enables AND gates 304 and 313 (FIG. 7) so that read control signals will be generated during the read portion of the 8 kHz clock cycle.

During the write portion of the next 8 kHz clock cycle, write B AND gate 312 (FIG. 7) is enabled and the several primary write control signals are generated. The process of generating write B control signals is identical to that described for generating the comparable write A control signal.

Since the system is set to write data into memory B 506 (FIG. 11), read A AND gate 304 (FIG. 7) is enabled and will pass all of the read portion of the 8 kHz clock cycle. The output of read cycle OR gate 307 (FIG. 7) triggers the generation of the signals required to recover the data stored in memory A 505 (FIG. 11) in a sequence determined by the algorithm stored in read-only memory 523 (FIG. 11) and causes this data to be converted to analog form for transmission to the receiving location. The steps in this process are as follows.

(a) The leading edge of the read cycle signal 307 (FIG. 7) sets read program flip flop 355 (FIG. 7B). This enables AND gate 356 so that FC/4 clock pulses are fed to decimal counter 357 (FIG. 7B).

(b) Output 2 of decimal counter 357 sets programmable read-only memory $\overline{OE}$ (output enable) flip flop 358 (FIG. 7B). The $\overline{Q}$ output of read-only memory enable flip flop 358 is used as the $\overline{OE}$ (output enable) control signal for read-only memory 523 (FIG. 11). The presence of the $\overline{OE}$ control signal (Waveform J, FIG. 8) transforms the high impedance output of read-only memory 523 (FIG. 11) to a low impedance source of the data bits (ones and zeros) present at the selected address. Three of the data bits are connected to the PR (preset) inputs of read address counter 522 (FIG. 11).

(c) It will be noted that ROM OE (programmable read-only memory output-enable) flip flop 358 (FIG. 7) is reset by output 9 of decimal counter 357 (FIG. 7B) via OR gate 361 (FIG. 7B). During the period of the $\overline{OE}$ control signal, output 4 of said decimal counter 357 is inverted at 362 (FIG. 7B) and momentarily takes the $\overline{PE}$ (preset enable) input of read address counter 522 (not shown on the diagram) low so that read address counter 522 will count from the address specified by the data at the selected address in read-only memory 523 (FIG. 11). It will be remembered that the four bits recovered by multitone detector 507 (FIG. 11) were stored in latch 515 (FIG. 11) and were applied as address inputs to read-only memory 523 (FIG. 11).

(d) The fourth bit at the specified address in read-only memory 523 (FIG. 11) is applied as a clock to U/D flip flop 359 (FIG. 7B). If the control bit is a one, said U/D flip flop 359 will be set and the read clock pulses, output 9 of decimal counter 372 (FIG. 7C), will be steered by AND gate 364 (FIG. 7B) to the count down input of read address counter 522 (FIG. 11) so that said address counter will be decremented by the clock pulses. Read address counter 522 (FIG. 11) will continue to count down until the end of the particular segment as defined by a count of 1024 at the output of segment duration counter 532 (FIG. 11). If the control bit is a zero, U/D flip flop 359 (FIG. 7B) will not be set and said read address counter 522 will be incremented via AND gate 365.

(e) A count of 1024 from segment duration counter 532 (FIG. 11) clocks segment counter 530 (FIG. 11). This increments the address input of read-only memory 523 (FIG. 11) to the address from which the data describing the location in memory A 505 (FIG. 11) containing the first byte of the next segment of data is to be read.

(f) Output 8 of decimal counter 357 (FIG. 7B) triggers read memory flip flop 371 (FIG. 7C) via AND gate 387 (FIG. 7C) to continue the process of reading data from memory A 505 (FIG. 11) and converting the recovered data to analog form for transmission to a receiver.

(g) Output 9 of decimal counter 357 (FIG. 7B) resets PROM OE flip flop 358 (FIG. 7B) via OR gate 361.

(h) Output 10 (CO) of decimal counter 357 (FIG. 7B) is differentiated and the resulting pulse is applied via OR gate 360 (FIG. 7B) as a reset to read program flip flop 355 and decimal counter 357. The read-only memory and read control interface logic (FIG. 7B) remain reset until the occurrence of the next read cycle command via OR gate 307 (FIG. 7).

(i) The previously mentioned read memory command [output 8 of decimal counter 357 (FIG. 7B)] is ANDed at 387 (FIG. 7C) with read cycle command 307 (FIG. 7) to trigger read flip flop 371 (FIG. 7C). Setting this flip flop enables AND gate 388 so that Fc/4 clock pulses are fed to decimal counter 372 (FIG. 7C).

(j) Output 1 of decimal counter 372 (FIG. 7C) sets read address gate flip flop 374. This enables read memory A and read memory B AND gates 396 and 398, respectively, (FIG. 7C). During the period data is to be read from memory A 505 (FIG. 11), said AND gate 396 is enabled for a period equal in duration to the read address gate (waveform M, FIG. 8). Similarly a read address gate is generated by AND gate 398 (FIG. 7C) under the control of read address gate flip flop 374 (FIG. 7C). It will be noted that the read memory A address gate waveform is combined with the write memory A address gate waveform 351 (FIG. 7A) by OR gate 397 (FIG. 7C) and the combined signal enables tri-state address buffer A 520 (FIG. 11) at appropriate intervals to write data into or to read data from memory A. In like manner, memory B tri-state address buffer 521 (FIG. 11) is enabled by OR gate 399 (FIG. 7C) during the period data is to be written to or read from memory B. Read address gate (waveform M, FIG. 8) is terminated by output 8 of decimal counter 372 (FIG. 7C) via OR gate unit 375 (FIG. 7C). To eliminate any possible problems resulting from an unstable address bus, the address gates discussed in this paragraph begin before any other read control pulses are generated and end after reading of data from memory is completed.

(k) Output 2 of decimal counter 372 (FIG. 7C) sets read CE1 (chip enable 1) flip flop 376 (FIG. 7C). This enables read CE1 memory A AND gate 377 and read CE1 memory B AND gate 384. Depending upon the memory from which data is to be read, said AND gate 377 or said AND gate 384 passes a signal equal in duration to the read portion of the 8 kHz clock cycle. The read CE1 A signal (waveform N, FIG. 8) is combined with the write $\overline{CE1}$ waveform by NOR gate 378 (FIG. 7C) to generate the gated CE1 memory A waveform. The read CE1 memory B signal is combined with write $\overline{CE1}$ B signal by NOR gate 381 to generate gated CE1 memory B signal. These signals are fed to memory A 505 (FIG. 11) and memory B 506 (FIG. 11) respectively. Read CE1 waveform is terminated by output 8 of decimal counter 372 (FIG. 7C) via OR gate 379 (FIG. 7C).

(l) Memory OE (output enable) (waveform O, FIG. 8) is initiated when memory OE flip flop 382 is set by output 3 of decimal counter 372 (FIG. 7C). The output of this flip flop is steered to the memory from which data is to be read by NAND gates 385 and 386 (FIG. 7C). The RD A (read A) and RD B (read B) commands at the outputs of gates 304 and 313 (FIG. 7), respectively, determine memory from which data is to be read. The $\overline{OE}$ command is terminated by output 8 of decimal counter 372 via OR gate 383 (both in FIG. 7C). The above described set of control pulses result in the data at the selected memory address being present on the eight bit data bus connecting the outputs of memory A 505 (FIG. 11) and memory B 506 (FIG. 11) to the data input of D-to-A converter 503 (FIG. 11). [The next following paragraphs describe the pulses and the interrelationship of those pulses required to cause D-to-A converter 503 to convert the digital data to analog form].

(m) CS (chip select) flip flop 389 (FIG. 7C) is set by output 3 of decimal counter 372 (FIG. 7C). The $\overline{CS}$ signal (waveform P, FIG. 8), taken from the $\overline{Q}$ output of CS flip flop 389 must be present at the $\overline{CS}$ input of D-to-A converter 503 (FIG. 11) before the $\overline{WR}$ (write) pulse (waveform Q, FIG. 8) latches the data present at the input of D-to-A converter 503 (FIG. 11) into the input register thereof, and must be active throughout the period the $\overline{WR}$ pulse is present. The required conditions are realized by utilizing output 4 of decimal counter 372 (FIG. 7C) as the $\overline{WR}$ pulse, ANDing the WR pulse with the CS pulse present at the Q output of CS flip flop 389 via AND gate 390 (FIG. 7C) and terminating the $\overline{CS}$ pulse by resetting CS flip flop 389 with output 5 of said decimal counter 372 via OR gate 391.

(n) In a similar manner, the $\overline{LDAC}$ (load digital to analog converter) signal and the accompanying $\overline{WR}$ pulse is generated by setting LD flip flop 392 (FIG. 7C) with output 5 of said decimal counter 372. The required relative timing of the accompanying $\overline{WR}$ pulse (waveform S, FIG. 8) is realized by using the $\overline{Q}$ output of said $\overline{LD}$ flip flop 392 as the $\overline{LD}$ pulse and using AND gate 394 (FIG. 7C) to combine output 6 of said decimal counter 372 with the Q output of said flip flop 392. The $\overline{LD}$ pulse (waveform R, FIG. 8) is terminated by output of said decimal counter 372 (FIG. 7C) via OR gate 393.

(o) Since there is a single WR terminal on D to A converter 503 (FIG. 11), the two WR pulses discussed in the preceding paragraphs are combined by NOR gate 395 (FIG. 7C) interposed in the $\overline{WR}$ pulse signal path before connection to the $\overline{WR}$ input of D to A converter 503 (FIG. 11).

(p) The pulse at output 9 of decimal counter 372 (FIG. 7C) occurs after the particular byte of data has been converted to analog form. This pulse (waveform T, FIG. 8) is utilized as the clock for read address counter 522 (FIG. 11). As was previously mentioned, the read clock is steered to the memory from which data is to be read by gates 364 and 365 (FIG. 7B).

(q) Output CO (carry out) of decimal counter 372 (FIG. 7C) is differentiated by RC circuit 400 (FIG. 7C) and the resulting pulse (waveform U, FIG. 8) resets read flip flop 371 (FIG. 7C) and decimal counter 372 via OR gate 373 (both FIG. 7C). Read control logic (FIG. 7C) remains in the reset state until the time in the next read cycle it is activated by a read memory command from decimal counter 357 (FIG. 7B). The above described sequences [delineated (a) through (q)] are repeated until such time as push-to-talk switch 537 (FIG. 11) is released, thereby signalling that the originator of the message has reached the end of the current message. Release of push-to-talk switch 537 (FIG. 11) generates a voltage edge which is differentiated, and is applied to the reset input of read extension flip flop 317 (FIG. 7). Resetting said read extension flip flop 317 disables write gates 309 and 312 (FIG. 7) so that nothing further will be stored in memory [which, after release of push-to-talk switch 537 (FIG. 11), would only be amplifier noise]. It should also be noted that up/down counter 318 (FIG. 7) will not be incremented as resetting read extension flip flop 317 inhibits the generation of write clock pulses.

It is possible that when push-to-talk switch 537 (FIG. 11) is released, further data to be transmitted will be present in memory A 505 (FIG. 11) and/or memory B 506 (FIG. 11). To accommodate this possibility, AND gate 323 (FIG. 7) is enabled by resetting read extension flip flop 317 (FIG. 7). The presence of a segment count=8 pulse at the output of segment counter 530 (FIG. 11) triggers write A/write b flip flop 308 (FIG. 7) via OR gate 322 (FIG. 7) so that data in the remaining memory [as opposed the the memory from which data was being read at the time push-to-talk switch 537 (FIG. 11) was released] will be transmitted. Although the generation of write clock pulses stopped with the release of push-to-talk switch 537 (FIG. 11), the reading of data from memory and the transmission of data continues until a "borrow" is generated by up/down counter 318) (FIG. 7) indicating that the last byte of data has been read from memory. The low level indicating the presence of a "borrow" condition is inverted at 331 (FIG. 7) and is applied as an input to three-input AND gate 328. If the other two inputs are true (high levels indicating that the required conditions have been met):

(a) The system is in the transmit (T) mode; and (b) Push-to-talk switch 537 (FIG. 11) is open (this constitutes a level, rather than a pulse such as is generated at the time the push-to-talk switch is opened).

End-of-message timer 319 (FIG. 7) will be triggered at the time a "borrow" is generated by up/down counter 318 (FIG. 7). The leading edge of the end-of-message command (having a duration of approximately 60 milliseconds) is differentiated and the resulting pulse is applied to the reset input of count 8192 flip flop 314 (FIG. 7). Resetting this flip flop removes the high level at the reset input of tone duration flip flop (FIG. 11) and the high level at the tri-state enable input of latch 526 (FIG. 11). Under these conditions, tone duration flip flop 509 is settable and the four bits stored in latch 526 (FIG. 11) will appear at inputs of dual one-of-four decoder 518 (FIG. 11). A multitone signal generated at this time would be determined by the four bits stored in said latch 526.

It will be noted that three-input OR gate 538 (FIG. 11) is interposed in the path to the EN (enable) input of latch 526. One input to said OR gate 538 is count 8192 flip flop set. When this flip flop is set, the tri-state buffer portion of said latch 526 is disabled. This input will go low when count 8192 flip flop is reset, resulting in the enabling of the tri-state output of latch 526. The second input to said OR gate 538 is the positive-going end-of-message pulse from EOM timer 319 (FIG. 7) which disables the tri-state output of said latch 526 during the 60 millisecond duration of the end-of-message signal, causing the output lines of said latch to present a high impedance to the next circuit 518. Since the outputs of said latch 526 are returned to ground by pull-down resistors (not shown in FIG. 11), the inputs of dual one-of four decoder 518 (FIG. 11) will be 0000.

The leading edge of the end-of-message pulse is applied to the set input of tone duration flip flop 509 via OR gate 513 and delay 512 (both in FIG. 11). This circuit configuration assures that the data at the row and column inputs of multitone generator 514 (FIG. 11) are settled before tone duration flip flop 509 is set.

Setting said tone direction flip flop 509 enables multitone generator 514 (FIG. 11) which produces a multitone signal representing the binary word 0000 present at the row and column inputs of multitone generator 514. Since the system is in the transmit (T) mode, the multitone signal will be transmitted to the receiving location via output processor 504 (FIG. 11) and switch $S_3$. The multitone signal will be fed to multitone detector 507 (FIG. 11) via switch $S_2$. Said multitone detector 507 will recognize the transmitted multitone signal as valid and after approximately 45 milliseconds, it will output 0000 on its data lines and will then output a data-valid signal. The four bits representing the transmitted multitone signal will be stored in latch 515 (FIG. 11); however, no action will be taken in the transmitter as a result of the recovery of these four bits.

At the start of the just completed message, a multitone signal representing the four random bits chosen at the inception of the message was transmitted to the receiving location. When this multitone signal was recognized as valid, the four recovered bits were toggled into latch 515 (FIG. 11) by the leading edge of the accompanying data-valid signal. The trailing edge of that data-valid signal toggled data-valid flip flop 511 (FIG. 11) into the set state. As a result, the distribution of subsequent data-valid signals is inhibited by the low level at the $\overline{Q}$ output of said data-valid flip flop 511. [the $\overline{Q}$ output of said data-valid flip flop 511 is connected as the enabling input of AND gate 525 (FIG. 11) in the distribution path of subsequent data-valid signals].

The TE EOM (trailing-edge end-of-message) pulse from EOM timer 319 (FIG. 7) resets tone duration flip flop 509 (FIG. 11) via OR gate 510 (FIG. 11), terminating the end-of-message signal. The TE EOM pulse also:

(a) Resets transmit/receive flip flop 324 (FIG. 7);

(b) Resets standby/active flip flop 301 (FIG. 7) via OR gate 327 (FIG. 7), thereby forcing the transceiver into the "standby" mode, where it will remain until push-to-talk switch 537 (FIG. 11) is closed to initiate a transmission or a valid multitone signal is received.

(c) Resets read memory flip flop 326 (FIG. 7); and (d) Sets read extension flip flop 317 (FIG. 7).

OPERATION OF MEMORY CONTROL LOGIC IN THE RECEIVE MODE

Upon reception of a valid multitone signal, the transceiver goes into the active mode and prepares to receive and process the incoming scrambled message so that it is returned to its original, intelligible form.

In the receive mode, the several switches in the transceiver are disposed as follows, references being to FIG. 11 unless otherwise noted:

Switch $S_1$ is in the receive (R) position so that an incoming message (transmitted via a telephone circuit, radio link, etc.) is fed to input signal processor 501 (FIG. 11). Input signal processor 501 removes any high voltage noise pulses, filters the signal to remove out-of-band components and adjusts the level of the signal to suit the signal processing circuitry.

Switch $S_2$ being in the receive (R) position, directs the output of input signal processor 501 to the input of multitone detector 507. If the received multitone signal is valid, four bits defined by the received multitone signal will appear at the output of multitone detector 507. Shortly after the appearance of the four data bits, a data-valid signal will appear at a further output of multitone detector 507. The leading edge of the data-valid signal strobes said four data bits into latch 515.

Since data-valid flip flop 511 is reset at the time power to the transceiver is turned on or at the reception of an end-of-message command, the Q output of data-valid flip flop 511 will be high. This high level enables AND gate 525 so that the positive-going data-valid signal resulting from the reception of the valid multitone signal is passed by AND gate 525. The leading edge of the data-valid signal at the output of AND gate 525 is differentiated and the resulting pulse is applied to the clock input of standby/active flip flop 301 (FIG. 7), thus placing the transceiver in the active/receive mode.

Switch $S_3$ will be in the receive (R) position. In this position, switch $S_3$ causes the signal from output signal processor 504 to be fed to a speaker, headphones, telephone handset or other suitable transducer.

Setting standby/active flip flop 301 (FIG. 7) causes the following actions:

(a) Write A/write B flip flop 308 (FIG. 7) is set. This forces the writing of the first 8192 bytes of information into memory A 505 (FIG. 11); and (b) AND gate 302 (FIG. 7) is enabled, whereby the flow of 8 kHz clock pulses 531 (FIG. 11) to memory control logic 529 (FIG. 11) is initiated.

The trailing edge of the data-valid signal sets data-valid flip flop 511 (FIG. 11). In the receive mode, setting said data-valid flip flop prevents a second valid multitone signal (without an intervening EOM signal) from interrupting reception of a message by causing the receiver to start over with a new unscrambling algorithm. As was mentioned earlier, setting standby/active flip flop 301 (FIG. 7) enables the flow of 8 kHz clock pulses (waveform A, FIG. 8) to various write and read control circuits.

It will be remembered that each message is preceded by a multitone preamble defining the scrambling algorithm applied to the particular message. The duration of the multitone preamble is 8192 write clock pulses (a preamble of approximately one second duration); hence, writing of data into memory must be delayed until transmission of the multitone preamble is completed. In the receive mode, write address counter 519 (FIG. 11) is used as a timer during reception of the multitone preamble so write clock pulses must be generated during this interval, without generating control pulses which would cause the multitone preamble to be written into memory.

Examination of FIG. 7 reveals that in the receive mode count 8192 flip flop 314 (FIG. 7) is set by a count 8192 pulse output from write address counter 519 (FIG. 11). The presence of the count 8192 pulse indicates that the message preamble is ended and the writing of data into memory A should be started. Setting count 8192 flip flop produces a high level at the Q output of flip flop 314 (FIG. 7) which enables write CE1 (chip enable 1) gate 347 for memory A and gate 348 for memory B (both in FIG. 7A). If these control signals are not present, no data can be written into memory.

Since writing of data into memory in the receive mode was delayed by one count 8192 period, reading of data memory must be delayed an additional count 8192 period while memory A 505 (FIG. 11) is filled with data. The additional delay is realized in the following manner:

In the receive mode, three-input AND gate 315 (FIG. 7) is in the path of the count 8192 pulse to both write A/write B flip flop 308 and read memory flip flop 326 (both in reference to FIG. 7). It will be understood that if three-input AND gate 315 of FIG. 7 is to pass a pulse all three inputs must simultaneously be high. In the receive mode, input R is high at all times. The count 8192 output goes high for approximately one microsecond as an indication that a count of 8192 has been reached. The delay (approximately two microseconds) indicated in the path from the Q output of count 8192 flip flop (FIG. 7) to said AND gate 315 delays the arrival of the high level at the Q output of said count 8192 flip flop 314 at the input of said AND gate 315 until the count 8192 signal from write address counter 519 (FIG. 11) has ended; hence, write A/write B flip flop 308 (FIG. 7) will not be toggled to write memory B and read flip flop 326 will not be set to read memory A until the arrival of a second count 8192 pulse indicates that memory A has been filled with data.

Since write A/write B flip flop 308 (FIG. 7) was set (forced into the write A state) when standby/active flip flop 301 (FIG. 7) was set by the leading edge of the data-valid pulse, AND gate 309 (FIG. 7) is enabled. This results in a flow of 8 kHz clock pulses during the write portion of the 8 kHz clock cycle. The output of said AND gate 309 serves as write A command and as a write cycle command via OR gate 306 (FIG. 7).

With reference to FIG. 7A, the positive-going edge of the write cycle command sets write program flip flop 335. Since the Q output of write program flip flop 335 enables AND gate 334, the flow of Fc/4 clock pulses to decimal counter 337 (FIG. 7A) is initiated. The resulting outputs of said decimal counter 337 perform the following functions:

(a) Output 1 sets write address gate flip flop 340 (FIG. 7A). The Q output of said flip flop is combined with the write A command 309 (FIG. 7) by AND gate 315 (FIG. 7A) to enable memory A 505 (FIG. 11) and tri-state address buffer 520 (FIG. 11).

(b) Output 8 of decimal counter 337 (FIG. 7A) resets write address gate flip flop 340. The resulting address gate (waveform B, FIG. 8) starts before any data is present at the input of memory A 505 (FIG. 11) and ends after the completion of writing the particular byte of data into memory A. This assures that the memory address inputs will be stable while data is being written into memory.

(c) Output 2 of decimal counter 337 (FIG. 7A) is fed to an input of NAND gate 338 (FIG. 7A). Since said NAND gate is enabled by setting write address flip flop 340, the output of this gate forms the $\overline{WR}$ (write) pulse (waveform C, FIG. 8) for A-to-D converter 502 (FIG. 11). The negative-going edge of the $\overline{WR}$ pulse initiates the sampling of the incoming message signal and the positive-going edge of the $\overline{WR}$ pulse initiates the conversion of the sample to a byte of digital data.

(d) Approximately 600 nanoseconds after the trailing edge of the $\overline{WR}$ pulse, conversion of the sample to digital form is completed and an $\overline{INT}$ (interrupt) pulse is generated. The $\overline{INT}$ pulse (waveform D, FIG. 8) is inverted at 343 (FIG. 7A) and sets A-to-D ready flip flop 342 (FIG. 7A). The $\overline{Q}$ output of said flip flop forms a $\overline{RD}$ pulse (waveform E, FIG. 8). This pulse enables the tri-state output of A to D converter 502 so that the byte of data resulting from the conversion of the message signal sample to digital form appears on the data bus at the data inputs of both memory A 505 and memory B 506 (both referring to FIG. 11). It will be noted that A-to-D ready flip flop 342 (FIG. 7A) is reset by output 6 of decimal counter 337 via OR gate 344 (both referring to FIG. 7A). This timing assures that the data from A-to-D converter 502 (FIG. 11) is present at the data inputs of the selected memory until the write cycle for that particular byte of data is completed.

(e) Output 4 of decimal counter 337 (FIG. 7A) sets CE1 (chip enable 1) flip flop 345 (FIG. 7A) to generate $\overline{CE1}$ (waveform F, FIG. 8) and $\overline{WE}$ (write enable) gate (waveform G, FIG. 8). It will be noted that $\overline{CE1}$ and $\overline{WE}$ are coincident, as both pulses must be present to cause data to be written into memory. The CE1 pulse is steered to memory A 505 (FIG. 11) by AND gate 347 (FIG. 7A) using CE1 memory A 305 (FIG. 7) as a control signal. The second control signal input to AND gates 347 and 348 (both referring to FIG. 7A) is the output of OR gate 367 (FIG. 7A). The output of OR gate 367 (FIG. 7A) is high when count 8192 flip flop 314 (FIG. 7) is set or receive/transmit flip flop 324 (FIG. 7) is set [the transceiver being in the transmit (T) mode]. When the transceiver is in this mode, data representing the input audio signal is stored in memory A 505 (FIG. 11) during the interval in which the multitone message preamble is transmitted. However, when the transceiver is in the receive mode, write clock pulses must be generated so that write address counter 519 (FIG. 11) can act as a timer during the multitone preamble to the message. During the transmission of the message preamble [before count 8192 flip flop 314 (FIG. 7) is set], the flow of $\overline{CE1}$ (chip enable 1) pulses to the memories is blocked, preventing the storage of data representing the multitone preamble.

(f) The Q output of CE1 gate flip flop 345 (FIG. 7A) enables NAND gate 349 (FIG. 7A) and the write A command 309 (FIG. 7) steers the WE (write enable) A signal to memory A 505 (FIG. 11).

(g) When the transceiver is in the transmit mode, the T output of transmit/receive flip flop 324 (FIG. 7) is high, enabling AND gate 320 via OR gate 311 (both in FIG. 7) so that output 9 of decimal counter 337 (FIG. 7A) serves as a count-up clock (waveform H, FIG. 8) for up/down counter 318 (FIG. 7) starting at the beginning of the multitone message preamble. When the transmitter is in the receive (R) mode, the T output of transmit/receive flip flop 324 is low and the flow of write clock pulses from decimal counter 337 (FIGS. 7 and 7A) is blocked by AND gate 320 (FIG. 7) until the end of the multitone message preamble.

(h) The "carry" (CO) of decimal counter 337 (FIG. 7A) is differentiated and the resulting pulse (waveform I, FIG. 8) resets write program flip flop 335 and decimal counter 337 via OR gate 339 (all in FIG. 7A).

(i) It will be noted that only one byte of data is written into memory during a given 8 kHz clock cycle. Also, the sequence of actions described in the preceding paragraphs continue without reading data from memory until 8192 bytes of data have been written into memory A 505 (FIG. 11). An output pulse is then generated by write address counter 519 (FIG. 11). This pulse accomplishes the following:

Since the system is in the receive (R) mode, AND gate 315 (FIG. 7) is partially enabled [lacking the delayed Q output of count 8192 flip flop 314 (FIG. 7) and a count 8192 pulse from write address counter 519 (FIG. 11)]. The first arriving count 8192 pulse sets count 8192 flip flop 314 (FIG. 7) and the Q output of count 8192 flip flop 314 goes high. However, the duration of the count 8192 pulse from write address counter 519 (FIG. 11) (approximately one microsecond) is short compared to the delay (approximately 2 microseconds) interposed between the Q output of count 8192 flip flop 314 (FIG. 7) and the enabling input of AND gate 315. This circuit configuration assures that the first generated count 8192 pulse (FIG. 11), occurring at the end of the received multitone message preamble, does not toggle write A/write B flip flop 308 (FIG. 7) into the write B state.

In the receive (R) mode, read memory flip flop 326 (FIG. 7) is set by the second count 8192 pulse via AND gate 315 and OR gate 325 (FIG. 7). Setting flip flop 326 enables AND gates 304 and 313 (FIG. 7) so that read control signals will be generated during the next and subsequent read portions of the 8 kHz clock cycle.

During the write portion of the next 8 kHz clock cycle, write B AND gate 312 (FIG. 7) is enabled and the several primary write B control signals are generated. The process of generating each of the write B control signals is identical to that described for generation of the comparable write A control signal.

Since the system is set to write data into memory B 506 (FIG. 11), read A AND gate 304 (FIG. 7) is enabled and will pass the read portion of the 8 kHz clock cycle. The output of read A AND gate 304 via OR gate 307 triggers the generation of the signals required to recover data stored in memory A 505 (FIG. 11) in a sequence determined by the scrambling algorithm stored in read-only memory 523 (FIG. 11). It will be noted that the most significant address input ($A_{12}$) of read-only memory 523 is controlled by the receive (R) output of transmit/receive flip flop 324 (FIG. 7). This circuit configuration facilitates storage of the unscrambling algorithms in the upper half of read-only memory 523. These algorithms are accessed by the data recovered from the multitone signal transmitted as a preamble to the particular message.

The selected algorithm causes the received data to be converted to its original analog form for presentation to the user via the output transducer (speaker, headphones, etc., in the instance of audio useage). The steps in this process are as follows:

(a) The leading edge of the read cycle signal from gate 307 (FIG. 7) sets read program flip flop 355 (FIG. 7B). This enables AND gate 356 so that Fc/4 clock pulses are fed to decimal counter 357 (FIG. 7B).

(b) Output 2 of said decimal counter 357 sets programmable read-only memory flip flop 358 (FIG. 7B). The $\overline{Q}$ output of this flip flop is used as the $\overline{OE}$ (output enable) control signal (waveform J, FIG. 8) for programmable read-only memory 523 (FIG. 11). The presence of the $\overline{OE}$ control signal transforms the high impedance output of read-only memory 523 (FIG. 11) to a low impedance source of the data bits (ones and zeros) present at the selected address. The data bits are connected to selected PR (preset) inputs of read address counter 522 (FIG. 11).

(c) Programmable read-only memory flip flop 358 (FIG. 7B) is reset by output 9 of decimal counter 357 via OR gate 361 (FIG. 7B). During the period when the $\overline{OE}$ control signal is present, output 4 of decimal counter 357 is inverted at 362 (FIG. 7B) and momentarily takes the $\overline{PE}$ (preset enable) input of read address counter 522 (FIG. 11) low, programming read address counter 522 to start from the count determined by the data at the selected address in read-only memory 523. As previously explained, the four bits recovered by multitone detector 507 (FIG. 11) were stored in latch 515 and were applied as address inputs to read-only memory 523 (FIG. 11).

(d) The fourth bit at the specified address in read-only memory 523 (FIG. 11) is applied as a clock input to U/D flip flop 359 (FIG. 7B). If the control bit is a one, said U/D flip flop will be set and the read clock pulses, output 8 of decimal counter 372 (FIG. 7C), will be steered by AND gate 364 (FIG. 7B) to the count down input of read address counter 522 (FIG. 11) so that said counter will be decremented by each clock pulse. Said read address counter will continue to count down until the end of the particular segment as defined by a count 1024 output from segment duration counter 532 (FIG. 11). If the control bit is a zero, U/D flip flop 359 (FIG. 7B) will not be set and read address counter 522 (FIG. 11) will be incremented.

(e) Referring to FIG. 11B, the count 1024 output from segment duration counter 532 increments segment counter 530. Incrementing said segment counter 530 increments the address input to read-only memory 523. The new address in read-only memory 523 contains the data determining the starting location in memory A 505 for reading the next segment of data.

(f) Output 8 of decimal counter 357 (FIG. 7B) triggers read memory flip flop 371 (FIG. 7C) via AND gate 387 (FIG. 7C) to continue the process of reading data from memory A 505 (FIG. 11) and converting the recovered data to analog form for reproduction by the output transducer.

(g) Output CO of decimal counter 357 (FIG. 7B) is differentiated and the resulting pulse is applied via OR gate 360 (FIG. 7B) as a reset to read program flip flop 355 and decimal counter 357 (FIG. 7B). The read-only memory and read control interface logic (FIG. 7B) remains reset until the occurrence of the next read cycle command via gate 307 (FIG. 7).

(h) Output 1 of decimal counter 372 (FIG. 7C) sets read address gate flip flop 374 (FIG. 7C). This enables read memory A and read memory B AND gates 396 and 398 respectively (FIG. 7C). While data is being read from memory A 505 (FIG. 11), said AND gate 396 passes a pulse equal in duration to the read address gate signal. The read memory A address gate signal is combined with the write memory A address gate signal 351 (FIG. 7A) by OR gate 397 (FIG. 7C) and the combined signal enables tri-state address buffer A 520 (FIG. 11) at appropriate intervals to write data into memory A or to read data from memory A. In like manner, memory B tri-state address buffer 521 (FIG. 11) is enabled via OR gate 399 (FIG. 7C) during the period when data is to be written to or read from Memory B. Read address gate (waveform M, FIG. 8) is terminated by output 8 of decimal counter 372 (FIG. 7C). To eliminate any possible problems resulting from an unstable address bus, the address gate signals discussed in this paragraph begin before any other read control pulses are generated and end after the last read control pulse is ended.

(i) Output 2 of decimal counter 372 (FIG. 7C) sets read CE1 (chip enable 1) flip flop 376 (FIG. 7C). This enables read CE1 memory A AND gate 377 and read CE1 memory B AND gate 384 (FIG. 7C). Depending upon the memory from which data is to be read, gate 377 or gate 384 passes a signal equal in duration to the read CE1 signal. The read CE1 A signal (waveform N, FIG. 8) is combined with the write CE1 A by NOR gate 378 (FIG. 7C) to generate the gated $\overline{CE1}$ (FIG. 7C) memory A waveform. The read CE1 B signal is combined with write CE1 B signal by NOR gate 381 (FIG. 7C) to generate the gated $\overline{CE1}$ memory B waveform. These signals are fed to memory A 505 (FIG. 11) and memory B 506 (FIG. 11) respectively. Read CE1 is terminated by output 8 of decimal counter 372 (FIG. 7C).

(j) Memory OE (output enable) (waveform O, FIG. 8) is initiated when memory OE flip flop 382 (FIG. 7C) is set by output 3 of decimal counter 372 (FIG. 7C). The output of memory OE flip flop 382 is steered to the memory from which data is to be read by NAND gates 385 and 386 (FIG. 7C). The RD A (read A) 304 (FIG. 7) and the RD B (read B) 313 (FIG. 7) three-input AND gates determine the memory from which data is to be read. The OE command is terminated by output 8 of decimal counter 372 (FIG. 7C).

(k) The above described set of control pulses cause the data at the selected memory address to appear on the eight bit data bus connecting the outputs of memory A 505 (FIG. 11) and memory B 506 (FIG. 11) to the data input of D-to-A converter 503 (FIG. 11). The following paragraphs describe the pulses and the interrelationship of those pulses, required to cause D-to-A converter 503 to convert the digital data to analog form.

(l) CS (chip select) flip flop 389 (FIG. 7C) is set by output 3 of decimal counter 372 (FIG. 7C). The $\overline{CS}$ signal (waveform P, FIG. 8) is taken from the $\overline{Q}$ output of CS flip flop 389. This waveform is combined with the output of decimal counter 372 (FIG. 7C) by AND gate 390 and NOR gate 395 (FIG. 7C) to form the $\overline{WR}$ pulse for the input register of D-to-A converter 503 (FIG. 11). The $\overline{CS}$ pulse must be present at the $\overline{CS}$ input of D-to-A converter 503 before the $\overline{WR}$ (write) pulse (waveform Q, FIG. 8) latches the data present on the data bus into the input register of D-to-A converter 503 (FIG. 11) and must be active throughout the period the $\overline{WR}$ pulse is present. $\overline{CS}$ flip flop 389 (FIG. 7C) is reset by output 5 of decimal counter 372 (FIG. 7C).

(m) In a similar manner, the $\overline{LDAC}$ (load digital to analog converter) signal and the accompanying WR pulse are generated by setting LD flip flop 392 (FIG. 7C) with output 5 of decimal counter 372 (FIG. 7C). The relative timing of the accompanying $\overline{WR}$ pulse (waveform S, FIG. 8) is realized by using the $\overline{Q}$ output of LD flip flop 392 as the $\overline{LD}$ pulse and using AND gate 394 to combine output 6 of decimal counter 372 with the Q output of LD flip flop 392 (all in reference to FIG. 7C). The $\overline{LD}$ pulse (waveform R, FIG. 8) is terminated by output 7 of decimal counter 372 (FIG. 7C).

(n) Since there is a single $\overline{WR}$ terminal on D-to-A converter 503 (FIG. 11), the two WR pulses discussed in the preceding paragraph are combined by NOR gate 395 (FIG. 7C) before connection to the $\overline{WR}$ input of D-to-A converter 503 (FIG. 7C).

(o) Output 9 of decimal counter 372 (FIG. 7C) occurs after the particular byte of data has been converted to analog form and this pulse (waveform T, FIG. 8) clocks read address counter 522 (FIG. 11). As was previously mentioned, the read clock pulse is steered to the selected input (count up or count down) of read address counter 522 (FIG. 11) by AND gates 364 and 365 (FIG. 7B).

(p) Output 10 (designated CO) of decimal counter 372 (FIG. 7C) is differentiated and the resulting pulse (waveform U, FIG. 8) resets read flip flop 371 and decimal counter 372 via OR gate 373 (all in reference to FIG. 7C). Read control logic (FIG. 7C), remains in the reset state until the time in the next read cycle it is activated by a read memory command from decimal counter 357 (FIG. 7B).

The above described sequence [(a) through (p)] is repeated until such time as an "end-of-message" signal is received.

Upon completion of the processing of the last byte of data stored in memory, an end-of-message multitone signal is generated.

Referring to FIG. 11, the leading edge of the data-valid pulse accompanying the received end-of-message pulse causes the four bits (0000) defined by the received multitone signal to be stored in latch 515 (FIG. 11). [the stored bits are applied to address inputs of read-only memory 523 (FIG. 11B), but no action results since the data-valid dependent control signals are not generated]. The four recovered bits are applied to end-of-message decoder 516 causing the output of said end-of-message decoder to go high. As was previously explained, data-valid flip flop 511 was set by the trailing edge of the data-valid pulse derived from the first received valid multitone signal. Since data-valid latch 511 is in the set mode at the time of reception of the end-of-message multitone signal, the positive-going end-of-message signal present at the output of decoder 516 is passed by NAND gate 524. The leading edge of this signal is differentiated and inverted at 533 to form the "RCVD LE EOM" (received leading edge end-of-message) signal. Said RCVD LE EOM performs the following functions:

Resets standby/active flip flop 301,
Resets count 8192 flip flop 314,
Sets read extension flip flop 317,
Resets read memory flip flop 326,
Resets transmit/receive flip flop 324 and
Resets up/down counter 318.

While we have shown and described certain illustrative embodiments in accordance with the present invention, it is to be understood that the invention is not limited thereto but is susceptible of changes and variations as are known to persons of ordinary skill in the art and we therefore should not be limited to the specific components and connections shown and described herein but intend to cover such changes and modifications as are obvious to those skilled in the art.

What is claimed is:

1. A privacy signalling system comprising:

means for supplying input signals to be transmitted from a first point to a receiving point, means for sampling a version of said input signals into recurrent series of successive samples of predetermined time durations, means for interposing different amounts of time-shift of the successive samples of a series whereby reception and reproduction at a receiving point of a duplicate version of said input signals as supplied at said first point necessitates the interposition of complementary time-shifts of the signal samples as received at said receiving point, means for transmitting said time-shifted signals from said first point to at least one receiving point, means for receiving the signals transmitted to said one receiving point, means included in said signal receiving means for interposing different amounts of time-shift in the samples of each series, coordinatable respective means at said first point and at said one receiving point each including a selectably addressable memory for complementarily changing the amount of time-shift interposed in the transmission of successive signal samples and the reproduction of the received versions thereof in accordance with a predetermined sequence of different time-shifts called for at an addressed location in the respective memories at said first point and said one receiving point, means including a first reference frequency source at said first point and a further reference frequency source at said one receiving point of equal reference frequency, means responsive to said first reference frequency source for recurrently counting through a plurality of successive different counts, means coupled to said counting means for latching onto and retaining one of said counts until released, means responsive to said latching and retaining means for providing at least one tone representative of the count retained therein, tone transmitting means for providing duplication at said receiving point of the count-representative output of said tone-providing means, and means including respective tone-detection means at said first point and said one receiving point for supplying to the respective ones of said memories coordinate addresses for the sequences of complementary time-shifts for recovery at said receiving point of the restored-sequence signal samples and therefore intelligible reproductions of the original signals.

2. The system defined in claim 1, wherein said means responsive to said latching and retaining means comprises means for providing a plurality of tones representative of the count retained therein.

3. The system defined in claim 2, further including:

means including at least one frequency divider responsive to said first reference frequency source at said first point for limiting the duration of the tone transmission to a predetermined amount of time sufficient for the plural tone-detection means to determine the coordinate memory addresses.

4. The system as defined in claim 3, wherein said last-defined means comprises means for limiting the tone transmission duration to a predetermined number of cycles of output of said first reference frequency source preceding each period of transmission of the sample and selectively delayed signals.

5. Privacy signalling apparatus as defined in claim 1, wherein the defined elements at said first point comprise transmitting elements in a first transceiver at said first point, and the defined elements for receiving and reproducing the signals at said one receiving point comprise receiving elements in a second transceiver, each transceiver including means for two-way communication with privacy afforded for the communication in each direction.

6. Privacy signalling apparatus as defined in claim 5, wherein common delay, memory, and reference signal generating means are used during transmission and reception in each transceiver.

7. A privacy signalling system comprising:

means to accept input signals to be communicated from a first point to at least one receiving point, means for dividing a version of said input signals into a series of successive segments of predetermined time durations, memory means at said first point for storing said segments, first means for generating stable clock signals, counting means responsive to said clock signal generating means for recurrently counting through a sequence of numbers, means responsive to said counting means for generating a control number momentarily substantially representative of the output thereof whereby said control number is substantially randomly chosen, means responsive to said generated control number for producing tonal output consisting of at least one tone representative of said control number, means for storing a multiplicity of predetermined respectively numbered scrambling algorithms, means responsive to the output of said tonal output producing means for accessing the correspondingly numbered algorithm, means for deriving from said memory means the segments of said input signal version scrambled in accordance with the accessed algorithm in order to impart to signals for transmission privacy characteristics, means for transmitting to at least one receiving point composite signals including said scrambled segments and said tonal output from said tonal output producing means, means for receiving and separating said composite signals at at least one receiving point, means for storing the received versions of said scrambled signal segments, means for generating a decoding version of stable clock signals at least closely approximating the output of said first clock signal generating means, means responsive to the received version of said tonal output and deriving therefrom said control number, means for storing decoder algorithms correlated with said multiplicity of algorithms for signal restoration at said receiving point, means responsive to said decoder clock signal and to said control number deriving means for selectively recovering the algorithm in current use from the stored algorithms for use in reception, and means responsive to said selectively recovered algorithm for taking the stored received versions of said scrambled signal segments and restoring them to unscrambled form whereby to restore their intelligibility.

8. A privacy signalling transceiver comprising:

means at a first point for supplying input signals to be transmitted to a second point;

means for dividing a version of said input signals into recurrent series of sequential segments of predetermined durations;

means including switchable selective delay means for introducing predetermined different amounts of time delay in the segments of each series preparatory to their transmission to said second point;

means for controlling the amounts of time delay to which the successive segments of a series are subjected, said controlling means including addressable memory means, means for generating a plurality of tones for signifying an address to be selected in the memory means, and means responsive to said plurality of tones and addressing said memory means to cause it to establish a predetermined sequence of delays for the signal segments preparatory to their transmission;

means for transmitting to said second point said plurality of tones for a time interval sufficient to convey to compatible equipment at said second point control information for enabling it to provide for each series of selectably-delayed segments as reproduced at said second point a series of complementary delays for restoring the segments as reproduced to their original sequence;

and means at said first point for switching the transceiver from a condition for transmitting to a condition for receiving signals from said second point, said tranceiver switching means comprising means active during signal reception at said first point and including said switchable selective delay means for introducing predetermined different amounts of time delay in the successive segments of a series of segments received from said second point, said predetermined different amounts of time delay introduced in the segments received from said second point being complementary to whatever delays said segments were subjected to at their transmission from said second point.

9. In a system for transmission and reception and reproduction of signals in privacy, first means at a sending station for processing signals for transmission including means for dividing the signals into recurrent series of discrete signal samples and for subjecting the samples in each series to a predetermined set of different time-shifts preparatory to their being transmitted, further means at a receiving station for receiving the transmitted signals and processing them complementarily to their processing for transmission in order to restore them to essential duplication of their original signal content, and locking means for establishing and holding during a limited transmission period the coordination between said first means and said further means whereby to enable said further means to unscramble the signals which were scrambled and transmitted, said locking means comprising:

means for generating and holding at the sending station a numeric code for a predetermined sequence of time-shifts, tone-generating means responsive to said numeric code for generating at least one tone representative thereof, means at said sending station responsive to said tone-generating means for establishing a succession of signal sample time-shifts having a predetermined relation thereto, means for briefly transmitting a version of the output of said tone-generating means to the receiving station to initiate the private transmission thereto of signals, and means at said receiving station responsive to the tonal output received from the sending station for establishing at said receiving station a succession of time-shifts for samples being received complementary to the time-shifts then being provided at said sending station.

10. Privacy signal sending apparatus comprising:

means for accepting input signals at a first point to be communicated to another point, means for sampling a version of said input signals into recurrent series of successive samples of predetermined time durations, selectably controllable means for interposing predeterminedly different amounts of time-shift of the successive samples of a series and thereby imparting a different sequence to the time-shifted samples whereby reception and reproduction at a receiving point of a duplicate version of said input signals as accepted at said first point necessitates the interposition of complementary time-shifts of signal samples at the receiving point, means for selectably controlling said time-shift interposing means to select one of a plurality of sequences of time-shift magnitudes, means providing at least one signal component identifying a selected sequence of time-shift magnitudes, and means for transmitting to the receiving point composite signals including the time-shifted samples of a version of said input signals and a version of the output of said signal component providing means.

11. Privacy signal sending apparatus as defined in claim 10, wherein said means for accepting input signals comprises means for accepting voice-representative signals from a switchable source, and said means for selectably controlling said time-shift interposing means to select one of a plurality of sequences of time-shift magnitudes comprises means actuated upon source switching for making a substantially random selection of a sequence from among said plurality of sequences.

12. Privacy signal sending apparatus as defined in claim 10, wherein said means for selectably controlling said time-shift interposing means comprises a source of oscillations of a predetermined frequency, counting means responsive to said source for producing a sucession of different counts, and means for latching to and holding the one of said counts momentarily present in said counting means, and said signal component providing means comprises means for producing plural tones having a predetermined relation to each sequence of time shifts.

13. Privacy signal receiving apparatus comprising:

means for accepting from a transmitting station time-sampled and sequence-scrambled signals and introductory tone bursts having predetermined relations to the scrambling sequence in use at a given time, means responsive to the received introductory tone bursts for interpreting the frequency thereof land storing a timing sequence represented thereby, and means responsive to said frequency interpreting and sequence storing means for interposing a sequence of delays in the time-sampled and sequence-scrambled signals which are complementary to the original sequence-scrambling delays of the samples.

14. Privacy signal receiving apparatus as defined in claim 13, wherein said means for interposing a sequence of delays in the time-sampled and sequence-scrambled signals comprises means for maintaining one sequence of delays in use until another burst of tone signals is received.

15. A privacy signalling system comprising a signal encoding and transmitting system for accepting input signals at a first point to be scrambled and transmitted to a second point, and a signal receiving and descrambling system for receiving the scrambled signals transmitted to the second point and restoring them substantially to their original content, said encoding and transmitting system comprising:

means for dividing said input signals into a series of successive segments of predetermined time durations, means for storing a predetermined multiplicity of algorithms each denoting a particular one of various altered sequences into which the order of said segments is to be changed for transmission, means for substantially randomly selecting one of said algorithms to be relied on until a further substantially random algorithm selection is made, means responsive to the selected algorithm for scrambling the segments of the input signals into the sequence dictated by the randomly selected one of said algorithms, and means effective upon the selection of an algorithm for transmitting to the receiving and descrambling system a coded message instructing the receiving and descrambling system as to the selection of the algorithm for the complementary changing of sequence of segments into their original sequence;

and said signal receiving and descrambling system comprising:

means for accepting the signal segments of predetermined durations as transmitted thereto from said signal encoding and transmitting system and changing their order in accordance with a selected sequence algorithm, means complementary to the algorithm multiplicity storing means of said encoding and transmitting system for storing a predetermined multiplicity of algorithms the respective ones of which call for complementary changes of sequence of the received signal segments for restoration of their original sequence, and means responsive to said coded message to respond to each change of selection of the sequence-determining algorithm effective at said first point for making the coordinated change of selection of the algorithm necessary for restoring the original sequence of the segments at said second point.

16. A privacy signalling system as defined in claim 15, wherein said means for substantially randomly selecting one of said algorithms to be relied on comprises:

a source of oscillations of a predetermined frequency, means responsive to said source for recurrently counting through a series of numbers from a first number to an ultimate number, means for receiving from said recurrently counting means and holding the number momentarily present in said recurrently counting means, and means for addressing said storing means in accordance with said received number to make available the respective algorithm stored therein to dictate the sequence in which the signal segments are to be transmitted.

17. A privacy signalling system as defined in claim 16, wherein said means for transmitting a coded message to the receiving and descrambling system comprises:

means responsive to said means for receiving and holding the momentarily present number for providing a plurality of tones of frequencies representing said number, and means for transmitting to the signal receiving and descrambling system an instructive message consisting of oscillations of said frequencies transmitted for a time duration of a lesser order of magnitude than said signal segments.

* * * * *